US005796023A

United States Patent [19]

Kumano et al.

[11] Patent Number: 5,796,023

[45] Date of Patent: Aug. 18, 1998

[54] KEYBOARD APPARATUS WITH WHITE KEYS AND BLACK KEYS HAVING ACTION MEMBER DRIVING SECTIONS AT SUBSTANTIALLY THE SAME LOCATION

[75] Inventors: Shinji Kumano; Tsuyoshi Sato, both of Shizuoka-ken, Japan

[73] Assignee: Yamaha Corporation, Hamamatsu, Japan

[21] Appl. No.: 649,061

[22] Filed: May 16, 1996

[30] Foreign Application Priority Data

May 22, 1995 [JP] Japan ..... 7-122873

[51] Int. Cl.[6] ..... G10C 3/12

[52] U.S. Cl. ..... 84/433; 84/439

[58] Field of Search ..... 84/433, 434, 439, 84/440

[56] References Cited

U.S. PATENT DOCUMENTS

| | | | |
|---|---|---|---|
| 3,570,359 | 3/1971 | Ohno | 84/423 |
| 3,903,780 | 9/1975 | Aliprandi | 84/433 |
| 4,248,130 | 2/1981 | Erickson et al. | 84/434 |
| 4,901,614 | 2/1990 | Kumano et al. | 84/1.1 |
| 5,081,895 | 1/1992 | Katsuta | 84/433 |
| 5,243,125 | 9/1993 | Yamaguchi | 84/745 |
| 5,571,983 | 11/1996 | Yamaguchi et al. | 84/745 |

FOREIGN PATENT DOCUMENTS

| | | |
|---|---|---|
| 56-99596 | 8/1981 | Japan . |
| 4107296 | 9/1992 | Japan . |
| 5954 | 1/1993 | Japan . |
| 522956 | 6/1993 | Japan . |

*Primary Examiner*—Michael L. Gellner
*Assistant Examiner*—Shih-yung Hsieh
*Attorney, Agent, or Firm*—Loeb & Loeb LLP

[57] ABSTRACT

A keyboard apparatus has a first frame (support member), and a keyboard including a plurality of white keys and black keys, each of the keys having a fulcrum and movably about the fulcrum with respect to the support member. Each of the black keys has an extension section connected to one end of each of the black keys. The extension section extends under operation sections of two adjacent white keys toward the free ends of the white keys. A white key driving section is provided adjacent to a free end portion of each of the white keys. A black key driving section is provided adjacent to a free end portion of each of the extension sections. The white key driving sections and the black key driving sections are located at substantially the same distance from their respective fulcrums, and drive movable sections such as mass body assemblies (action members) or key switches that are operated in association with the corresponding white keys and the black keys.

15 Claims, 15 Drawing Sheets

KEYBOARD APPARATUS WITH WHITE KEYS AND BLACK KEYS HAVING ACTION MEMBER DRIVING SECTIONS AT SUBSTANTIALLY THE SAME LOCATION

BACKGROUND OF THE INVENTION

1. Field of the Invention

The present invention relates to a keyboard apparatus that is used in a keyboard type electronic musical instrument, such as an electronic piano or the like, and a training apparatus to be used by a player in training on the piano and other keyboard type musical instruments.

2. Description of Related Art

Typical keyboard apparatuses for keyboard type musical instruments are described in Japanese Laid-open Utility Model Application SHO 56-99596, Japanese Laid-open Patent Application HEI 4-107296 (electronic organs, etc.), Japanese Utility Model Patent HEI 5-954 (electronic pianos, etc.), and Japanese Utility Model Patent HEI 5-22956 (acoustic pianos, etc.).

The keyboard apparatuses described in these references normally have a keyboard including a supporting member and a plurality of white keys and black keys (generally referred to as keys) mounted on the supporting member. Each of the plurality of keys is pivotally mounted about its fulcrum with respect to a supporting member and a driving section (an actuator section). When a key is depressed, the driving section drives a movable section such as a key switch, an action member including a hammer, a whipping (or whippen) assembly, a valve and the like. The actuator section (the driving section) is typically separated a specified distance from the fulcrum of the key.

Furthermore, there are other difficulties. For example, the keyboard apparatus needs to have other indispensable parts for each of the keys, such as a key stopper and a key guide. In addition, the length of a white key and the length of a black key are different from each other. Because of the difficulties described above, it is difficult to achieve an accurate transmission of force from the key to the movable sections. In particular, it is difficult to achieve a high level key stroke accuracy.

The key stroke accuracy is described with reference to FIG. 24 by taking an example in which a key switch using a cup-shaped flexible member, that defines a movable section, is depressed at a key actuator section.

Let us assume that a key switch S is depressed at an actuator section Aa. The actuator section As is provided at a central area CA of a key K along the length of the key K which is movable about a fulcrum O. Further, let us assume that the key switch S is closed at a switch stroke $A=|a1-a2|=5$ mm, and that the key switch S itself has a stroke error of ±0.1 mm.

When a lower end of the actuator section Aa at the key central area CA is positioned at a1 in a non-key depression state and at a2 in a key-depression state, respectively, the corresponding points at a key leading end section CB are positioned at b1 and b2, respectively. Since a section defined by points ΔO, a1 and a2, and a section defined by points ΔO, b1 and b2 are similar to each other, the above mentioned error is magnified at the key leading end section by a factor determined by a ratio between a distance O a1 and a distance O b1. As the distance ratio in this case is 1:2, the error at the central area CA is magnified two times at the key leading end section CB.

In contrast, when the key switch S is depressed at an actuator section Ab provided at the leading end section CB of the key K, the key switch S closes when a switch stroke B at the actuator Ab is B=A=5 mm. Therefore, the above-mentioned error is not changed and remains at ±0.1 mm.

The preceding paragraphs described the stroke error caused by the key switch. However, when a key has an error, for example, a slight arcuate curve formed during the manufacturing stage and when there are errors in both of the switch and the key, a similar problem may occur.

It is therefore appreciated that the closer the driving section and the movable section to the leading end section of the key, the higher the key stroke accuracy.

When other movable sections such as the key switch and the action members such as the hammers are located closer to the leading end section of the key, a similar effect is obtained.

For example, the above mentioned Japanese Utility Model Patent HEI 5-954 shows a keyboard apparatus having hammers. In the keyboard apparatus described in this reference, a driving section for driving the hammer (a movable section) may be located adjacent to a respective key leading end section to improve the stroke accuracy.

In the keyboard apparatus of Japanese Utility Model Patent HEI 5-954, after the key is depressed, the corresponding hammer is stopped when the hammer abuts against a hammer stopper, and simultaneously, the key is stopped as the key abuts against a lower limit stopper. Therefore, during assembly, positions of these stoppers are carefully adjusted and their thicknesses are carefully decided. However, if an error exists in abutting portions of the key and the hammer, or if the key stroke accuracy of the abutting portions deteriorates due to a secular variation, the inaccuracy is magnified at the leading end section of the hammer. In addition, the hammer stoppers develop plastic deformations due to a secular variation. As a result, the keys do not stop precisely, and the hammer causes vibrations as the corresponding key is struck, and the vibrations at the hammers transmit through members between the hammer and the key which results in key vibration. Furthermore, there are occasions in which a key switch is turned on twice when the key is depressed only once because of the hammer vibrations.

These drawbacks are unavoidable in the prior art keyboard structures because of the following reasons. Even when a keyboard apparatus does not have hammers, key guides and key stoppers have to be provided adjacent to the key leading end sections. In the case of an electronic musical instrument, key switches have to be provided adjacent to the key leading end sections. When a keyboard apparatus has hammers, the hammers are required to be movable in association with the movement of the keys, and the hammers require upper limit stoppers, lower limit stoppers, hammer guides, and the like. Therefore, while it is desirable to locate the driving sections and the movable sections adjacent to the key leading end sections, there are a variety of difficulties that prevent the driving sections and the movable sections from being located adjacent to the key leading end sections.

On the other hand, the stroke accuracy may be improved if the driving section and the movable section are located far from the fulcrum of the key. However, there is a particular problem that is associated with the length of the white key and the black key. While the white keys and the black keys are different in length, a counter force (that determines a key touch feeling) at an operating section of either the white keys and the black keys must be the same. It is difficult for the white keys and the black keys to provide the same counter force because they have different lengths.

For example, Japanese laid-open patent application SHO 56-99596 teaches a keyboard apparatus that provides the same key touch feeling at the operating sections of both the white keys and the black keys. According to the reference, key switches for the white keys and key switches for the black keys are shifted with respect to each other along the key length direction so that the key switches are provided in a staggered fashion. In this keyboard apparatus, the key stoppers and the key guides are placed relatively closer to the key leading end sections, and the key switches and the key depression sections (actuator sections) are located relatively far from the key leading end sections.

In accordance with this reference, the key switches have cup-shaped flexible members, and the keys are returned by the resilient force of the flexible members. The flexible members may be identical (the cup-shaped flexible members are formed in the same shape and the same thickness) for both the white keys and the black keys. In this keyboard apparatus, each of the key switches and each of the actuators that drive the key switches for the white keys are disposed relatively adjacent to the key leading end section. As a result, the key switches and the actuators are located relatively far from their rotary fulcrum sections, compared with other ordinary keyboard apparatuses in which key switches for both the white and black keys are disposed generally at the same position (about the center of the length of the white key). As a result, the stroke accuracy for the white keys is improved.

However, with respect to the black keys, the stroke accuracy does not improve. Furthermore, the staggered key switch structure makes the keyboard structure more complicated and assembly of the keyboard more difficult.

In a conventional keyboard apparatus that provides a key touch that is similar to the key touch provided by an acoustic piano, for example the one shown in the Japanese utility patent HEI 5-954, each of the keys is provided with a hammer (a mass). The masses are relatively concentrated at the tip portions of the respective hammers, and are provided in different sizes for the white keys and the black keys.

It is appreciated that when a player depresses white keys and black keys with a finger, a distance between the finger of the player and the fulcrum of the white key is generally different from a distance between the finger and the fulcrum of the black key. In order to provide the same counter force that is received by the finger, the masses are provided in different sizes for the white keys and the black keys. Namely, the mass of a hammer for the black key is smaller than the mass of a hammer for the white key. Furthermore, the white keys abut against their associated hammers at a position that is different from a position where the black keys abut against their associated hammers.

As described above, conventional keyboard apparatuses that have masses such as hammers suffer from the above mentioned problems of the stroke accuracy. In addition, action members having masses that are driven by the white keys have to be manufactured independently from action members for the black keys. As a result, the number of parts increases, and the number of steps in the outsert formation process and the part manufacturing process increases. In particular, the number of split metal molds for resin molding increases, and thus the overall cost increases.

Moreover, conventional keyboard apparatuses that have masses cannot provide the same static or dynamic let-off feeling that may be provided by an acoustic grand piano because the masses alone cannot provide effects that are created by the complex action mechanism of an acoustic grand piano.

Still further, in the conventional keyboard apparatuses, each of the keys is supported by a support member in a manner rotatable in a vertical direction. The fulcrum of the key in combination with a guide member restrict movements of the key in a left-to-right direction (a direction in which the keys are arranged) and in a rolling direction (a direction in which the key rolls about an axis extending between the front end and the rear end of the key). As a result, if there is a bent or a twist in the key, a tilt or a twist in the guide member, a warp in a coupling member, or a tiny error in the dimensional accuracy or the mounting accuracy of a component part, a twisting force is generated . In particular, when a key is long, it is likely that dimensional errors increases. Thus, the key does not move smoothly along the entire key stroke during depression of the key. As a consequence, other problems may arise such as generation of noises and deterioration of the key touch feeling.

SUMMARY OF THE INVENTION

It is an object of embodiments of the present invention to provide a keyboard apparatus having a driving member and a movable section to be driven by the driving member in which the key stroke accuracy of the movable section with respect to the driving member (particularly for the black keys) is substantially improved during depression of the key. In the case of a keyboard apparatus having action members including masses, a key stroke accuracy of the keys and the action members is improved, and a key touch feeling is also improved. In the case of a keyboard electronic musical instrument, sound generating position in a key depression stroke is also improved.

In accordance with an embodiment of the present invention, a keyboard apparatus has a support member, and a keyboard including a plurality of white keys and black keys. Each of the keys has a fulcrum and a free end portion, and is pivotally supported about the fulcrum on the support member. A driving section is provided adjacent to the free end portion of each of the white keys and the black keys, and a movable section driven by the driving section is provided for each of the keys.

The free end portion of each of the black keys has an extended portion that extends under operation sections of adjacent two of the white keys to an area adjacent to the free ends of the white keys, and the driving section to drive the black key is formed adjacent to the free end of the extended portion. As a result, the driving sections of the white keys and the black keys are generally located at the same distance from their respective fulcrums. The driving sections for the white keys and the black keys are both located adjacent to the leading end sections (free ends) of the white keys. As a consequence, the driving sections for both the white keys and the black keys are separated relatively far apart from their respective fulcrums. Accordingly, a stroke error that is generated at an abutting area between the driving section and movable section is not magnified at a location where the performer's finger touches the key, and thus the stroke accuracy of the movable section driven by the driving section is improved. Furthermore, since the driving sections are disposed about the same location along the key length direction, parts required to form the white keys and the black keys can be generally in the same shape and thus metal molds for molding the white keys and the black keys are generally in the same shape. Accordingly, the number of the parts and split metal molds for molding the parts is reduced, the cost is lowered, and assembly of the keys is facilitated.

In accordance with an embodiment of the present invention, a fulcrum section of each of the keys is provided with a structure that allows movements of the keys in a key depression direction and a key width direction with respect to the support member. The structure also restrict or prevents rolling of the key itself. For example, in accordance with an embodiment of the present invention, a plurality of key guide members is fixed to the support member. Each of the plurality of key guide members is inserted into each of the white keys and the black keys to restrict a position thereof in the key arrangement direction. Each of the key guide members preferably has a protruding portion that comes in contact with opposing internal walls of each of the keys at a point or in a small area approximate to the point. Furthermore, in preferred embodiments, the protruding portion is generally spherical. As a result, any dimensional errors in the keyboard apparatus are substantially absorbed, even when the keys are relatively long, and a smooth key movement is provided for the entire key stroke.

In accordance with another embodiment of the present invention, a keyboard apparatus has action members to be driven by the white keys and the black keys. The action members are formed generally in the same shape, and each of the action members is formed by a mass body assembly containing a mass body and a whipping function member.

For example, FIG. 23 shows a keyboard apparatus having action members Gw and Gb each having a mass. The action members Gw and Gb are rotated by a white key WK and a black key BK, respectively, as the white keys WK and the black keys BK are depressed. When a performer plays the key board apparatus, her fingers touch the white key WK and the black key WB generally at a position Pw and a position Pb, respectively. A distance W1 between the position Pw and a fulcrum of the white key O and a distance B1 between the position Pb and a fulcrum of the black key O are different from each other (W1>B1). However, the action members Gw and Gb are depressed at generally the same position adjacent to the leading end section of the white key, namely at a position P. Therefore, the stroke accuracy of the action members for both white and black keys is improved with respect to the key depression stroke.

Also, to provide substantially the same key touch feeling for both of the white keys and the black keys, moving fulcrums Q of the action members Gw and Gb are required to be slightly shifted from each other as shown in FIG. 23. Each of the action members Gw and Gb has a front section A extending from the moving fulcrum Q toward the key leading end side, and a rear section B extending from the moving fulcrum Q toward the key rear end side. The length a' of the front section A of the action member Gb for the black key needs to be slightly longer than the length a of the front section A of the action member Gw for the white key. However, the length b and the length b' of the section B are substantially the same (b=b').

Therefore, the action members Gw and Gb for the white keys and the black keys are formed generally in the same shape with their front sections A being slightly different in shape from each other and with the rear section B being substantially the same in shape. Accordingly, the same split mold can be commonly used at least for the rear sections B of both the white keys and the black keys. As a result, the number of split metal molds for molding the action members is reduced and thus the overall cost for the action members is lowered. If a slight difference in the key touch feeling between the white keys and the black keys is acceptable, all of the action members may be made in the same shape for both of the white keys and the black keys.

Each of the action members may be formed from a mass body assembly which is an assembly of a mass body and a whipping function member so that the mass body is released during a key depression stroke. As a result, each of the white keys and the black keys provides a key touch feeling (static let-off feeling and dynamic let-off feeling) equivalent to that obtained by an acoustic grand piano. Furthermore, the number of parts and split metal molds is reduced and the cost is lowered.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings.

DETAILED DESCRIPTION OF EMBODIMENTS

Embodiments of the present invention will be described below with reference to the accompanying drawings.

Figure 1:
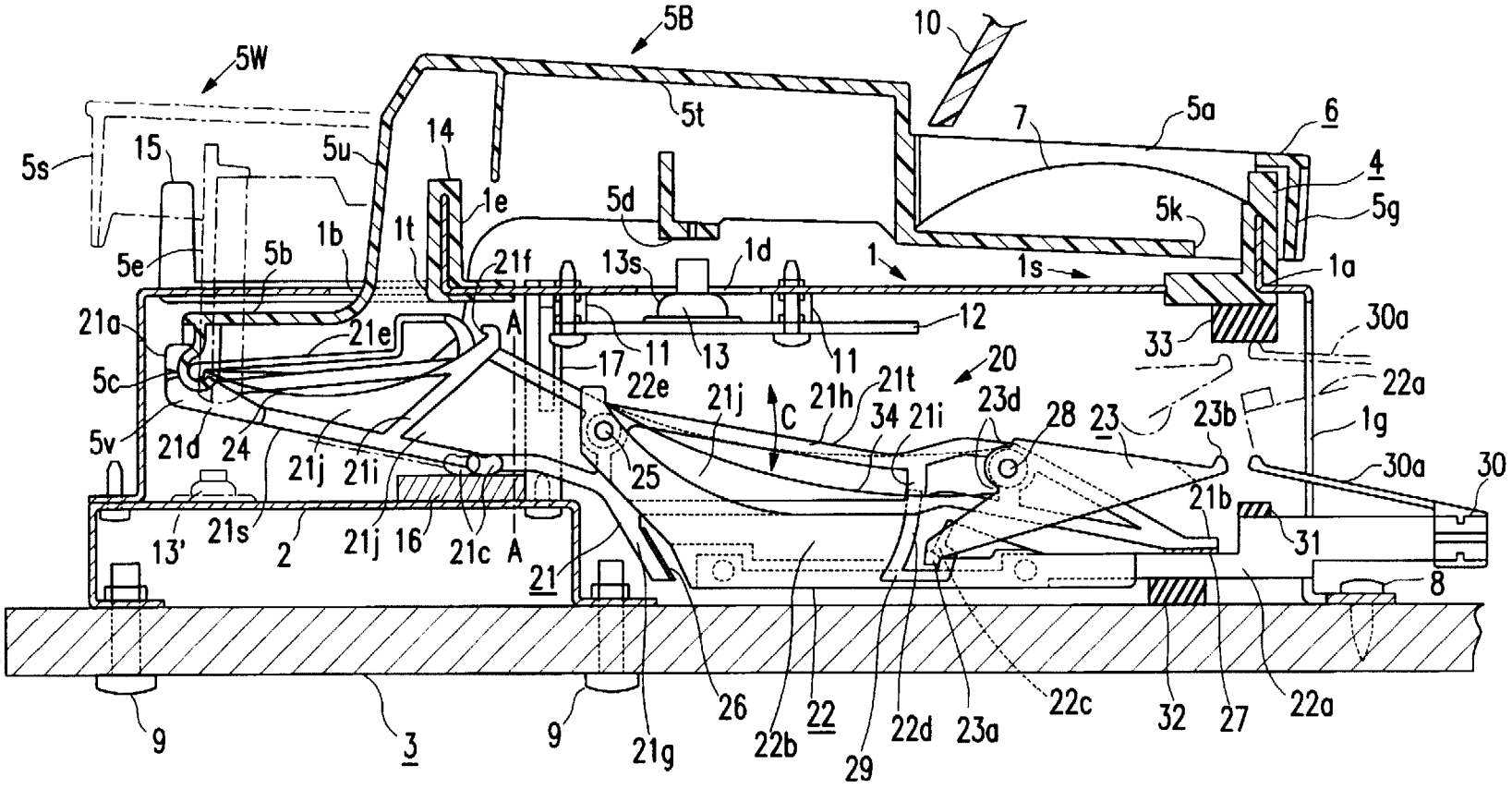
FIG. 1 shows a cross-sectional view of a black key taken along a key length direction when the key is not depressed in a key board apparatus in accordance with a first embodiment of the present invention.
Figure 2:
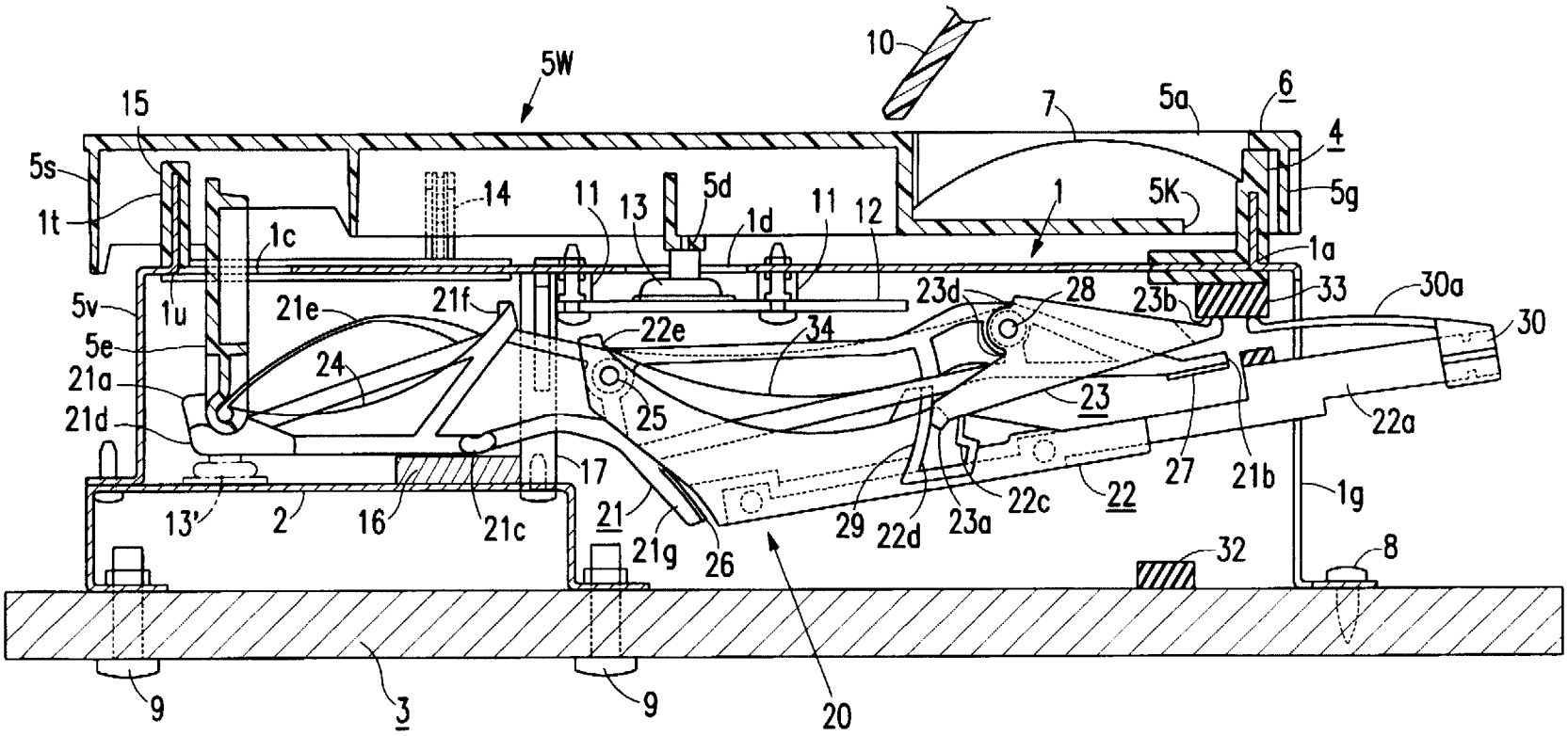
FIG. 2 shows a cross-sectional view of a white key taken along the key length direction when the key is depressed after a maximum key depression stroke in accordance with the first embodiment.
Figure 3:
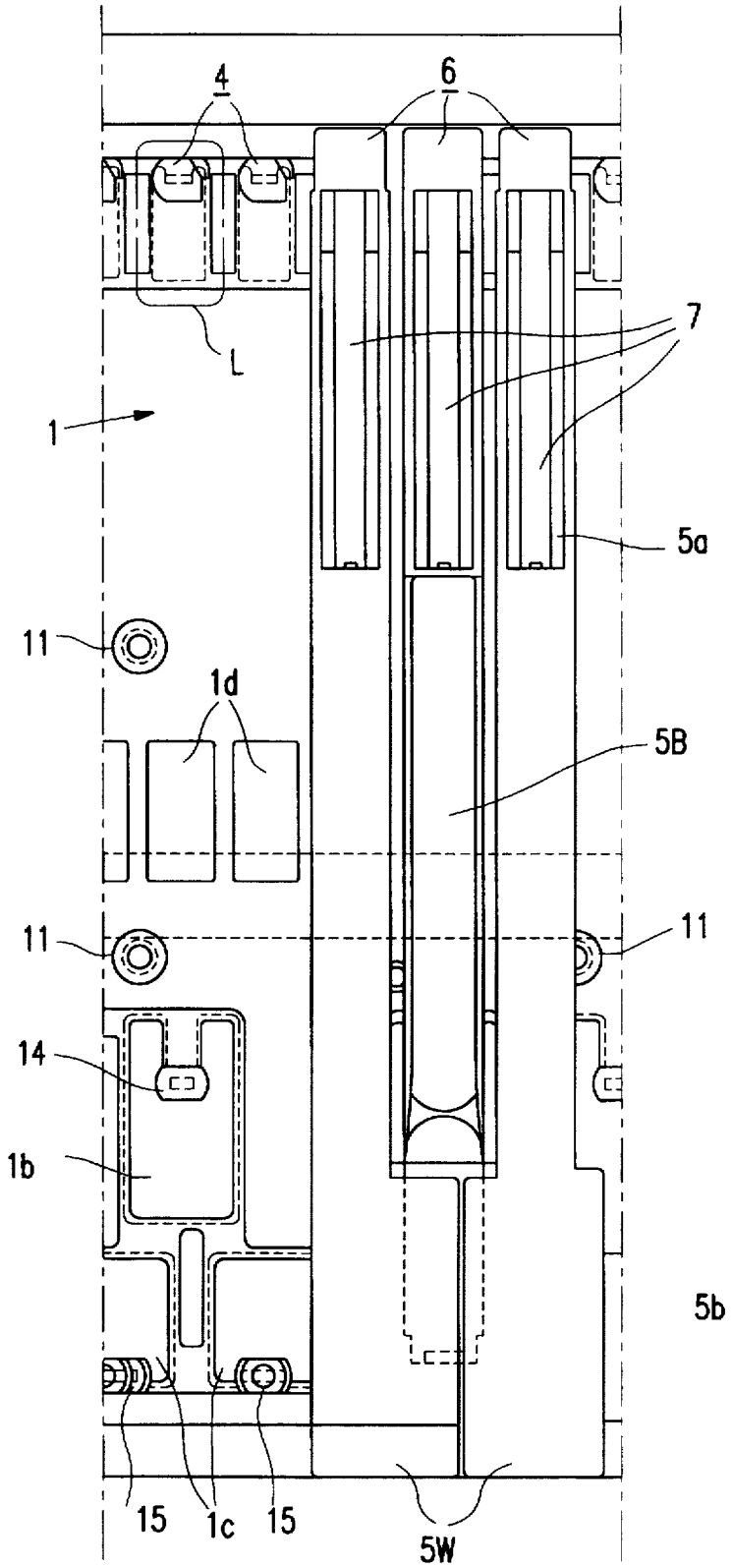
FIG. 3 shows a partial plan view of the key board apparatus in accordance with the first embodiment with part of the keys are removed.

FIG. 1 shows a cross-sectional view of a black key of a keyboard apparatus in a key length direction when the black key is not depressed in accordance with a first embodiment of the present invention. FIG. 2 shows a cross-sectional view of a white key along the key length direction when the white key is fully depressed after a maximum key depression stroke. FIG. 3 shows a partial plan view of the keyboard apparatus with portions of the keys being removed.

A first frame 1 defines a support member, and a second frame 2 defines another support member. Both of the frames 1 and 2 are fixed together by screws or the like The frames 1 and 2 are also fixed to a shelf board 3, which is a support base for the keyboard apparatus, with wood screws 8 and bolts 9. Spacer columns 17, that function as reinforcement members, are disposed between the first frame 1 and the second frame 2 at intervals along a key arrangement direction.

In preferred embodiments, the first frame 1 and the second frame 2 are made of a steel plate, such as an iron plate by a steel plate processing. The first frame 1 has a rear flat section 1*s* and protruding pieces 1*a*, that are cut in the rear flat section 1*s* and bent upright, at locations corresponding to the respective keys. A fulcrum section 4 for supporting each of the keys is formed with a resin on the protruding piece 1*a* by an outsert forming method in the support member 1. White keys 5W (shown in a phantom line in FIG. 1) and black keys 5B are formed by a resin and have key side fulcrum sections 6. Each of the key side fulcrum sections 6 are inserted in each of the corresponding fulcrum sections 4. Each of the key side fulcrum sections 6 movably support each of the white keys 5W and black keys 5B. Hereafter, the white key 5W and the black key 5B will be generally referred to as a "key 5" when the common features for the white keys and the black keys are described.

A leaf spring 7, which is bent in the form of an arch, is coupled between each of the keys 5 and each of the support member side fulcrum sections 4. By the resilient returning force of the leaf spring 7, the key side fulcrum section 6 and the support member side fulcrum section 4 are normally maintained in contact with each other. A housing cover 10 includes an operation panel (not shown). A rear side section of each of the keys 5 is covered by the housing cover 10 and defines an aperture 5*a* for mounting and dismounting the leaf spring 7 and an aperture 5*k* for mounting and dismounting the key 5.

The support member side fulcrum section 4 and the key side fulcrum section 6 are designed so that the key 5 is movable with respect to the first frame 1 in a key depression direction (vertical direction) and in a key width direction (in the left-to-right direction in FIG. 3), and substantially does not have a rolling movement (rotation about an axis extending in the key length direction of the key 5). This structure will be described in more detail below.

The black key 5B defines an extended section 5*b* that extends below the operation sections of two adjacent white keys 5W toward a free end section 5*s* of the white keys 5W. The extended section 5*b* passes through an aperture 1*b* defined in the first frame 1 and extends under the first frame 1. The extended section 5*b* has a driving section 5*c* that drives a corresponding action member (e.g., a first arm 21 and a second arm 22 which are described later). A key switch actuator 5*d* is provided under and in a central area 5*t* of the black key 5B.

A downwardly extending driving section 5e is also formed adjacent to the free end section 5*s* of the white key 5W as shown in FIG. 2. The driving section 5*e* passes through an aperture 1*c* defined in the first frame 1 and extends under the first frame 1 for driving a corresponding action member. A key switch actuator 5*d* is also provided under and in a central area of the white key 5W at a location adjacent to the actuator 5*d* for the black key 5B. The key 5 has a rear end face 5*g* that enhances the strength of the key side fulcrum section 6 and facilitates a change to a see-saw type key, that is described later with reference to a second embodiment.

The first frame 1 defines key switch apertures 1*d* at locations corresponding to the respective actuators 5*d* for the keys 5. Spacers 11 having screw holes are formed with a resin by an outsert forming method at a front side and a rear side of each of the apertures 1*d*. Switch substrates 12 are spaced from the under side wall of the first frame 1 by the spacers 11 and are disposed in parallel with one another at specified intervals. The switch substrates 12 are fixed to the first frame 1 by screws or the like.

Key switches 13 are disposed in parallel with one another. Each of the key switches 13 is mounted on a top surface of each of the switch substrates 12 and has a cup-shaped flexible member 13*s* at a position corresponding to the actuator 5*d* for each of the keys 5. When the key 5 is depressed as shown in FIG. 2, the actuator 5*d* presses the cup-shaped flexible member 13*s* by a specified stroke, closing contacts within the key switch 13 and generating a key depression signal.

Key switches 13 using this type of cup-shaped flexible members are known and described, for example, in the above mentioned Japanese Utility Model Application SHO 56-99596 and Japanese Utility Model Application HEI 4-107296. Accordingly, the detailed description is incorporated by reference, and the detailed description of the key switches 13 is omitted.

Protruding pieces 1*e* are cut in the first frame 1 and bent upright in a front area 1*t* closer to an end wall 5*u* of the black key 5B with respect to the apertures 1*d* at which the black keys 5B are mounted. Black key guides 14 are formed by outserting a resin on the protruding pieces 1*e*. The black key guides 14 are coupled with the corresponding black keys 5B to restrict or substantially eliminate movements of the black keys 5B in the key arrangement direction.

Protruding pieces 1*f* (see FIG. 2) are cut in the first frame 1 and bent upright in a further front area 1*u* closer to a front end wall 5*v* of the first frame with respect to the protruding pieces 1*e* at which the white keys 5W are mounted. White key guides 15 are formed by outserting a resin on the protruding pieces 1*f*. The white key guides 15 are coupled with the corresponding white keys 5W to restrict or substantially eliminate movements of the white keys 5W in the key arrangement direction.

Figure 4:
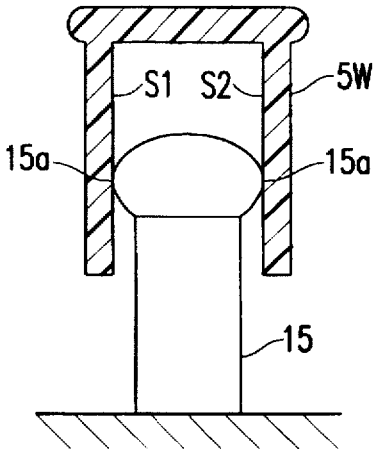
FIG. 4 shows a cross-sectional view of a white key and a white key guide shown in FIG. 2 taken along a key width direction in which the white key and the white key guide are in contact with each other.

An upper end section of each of the white key guides 15 has spherical bulging sections 15*a* that protrude in the key width direction, as shown in FIG. 4. The spherical bulging sections 15*a* come in point contact or near point contact with the opposing internal walls S1 and S2 of the white key 5W, respectively.

Each of the black key guides 14 also has bulging sections similar to the bulging sections of the white key guide 15, that come in point contact or near point contact with the opposing internal walls of the black key 5B.

In accordance with this embodiment, the black key guides 14 and the white key guides 15 are formed form a resin. However, the black key guides 14 and the white key guides 15 may be formed from any one of appropriate materials, such as, for example, a polymeric meterial, a soft metal, and the like.

As a result, friction between the keys 5 and the key guide members (namely, the black key guides 14 and the white key guides 15) is reduced, resulting in a smoother key operation.

As shown in FIGS. 1 and 2, a mass body assembly 20 defines an action member of the keyboard apparatus in accordance with the first embodiment. The mass body assembly 20 includes a first arm 21 defining a main portion of the action member, a second arm 22 defining a mass body, and a let-off lever 23 defining a let-off function member that corresponds to a jack of a piano. The first arm 21 and the let-off lever 23 define a whipping function member that corresponds to a whipping assembly of a piano. The first arm 21 and the let-off lever 23 are formed from a resin, and the second arm 22 is formed from a weight member 22*a* and a resin section 22*b* outserted on a part of the weight member 22*a*. The weight member 22*a* is made of a heavy metal material, such as iron or any one of other appropriate materials, and the resin section 22*b* is outserted on a front half section of the heavy metal material. The let-off function member 23 operates to release the mass body (the second arm 22) from the first arm 21 during depression of the key 5.

The first arm 21 extends in the key length direction of the key 5 and has a front end section 21*a* adjacent to the front end section (the free end) of the key 5 and a rear end section 21*b* adjacent to the rear end section (the fulcrum section) of the key 5. The first arm 21 has the widest area (in a vertical direction in FIGS. 1 and 2) located about one third (⅓) of the entire length of the first arm 21 from the front end section 21*a*. The first arm 21 has a partially cylindrical moving fulcrum 21*c* at a lower part thereof that is mounted on a support member 16 fixed on the second frame 2. The first arm 21 is supported in a manner rotatable in directions shown by arrows C in FIG. 1 about a fulcrum at a contact point defined between the cylindrical moving fulcrum 21*c* and the support member 16. The first arm 21 is also slightly movable on the support member 16, as it is rotated, in the key length direction.

The first arm 21 has a front side section 21*s* extending forwardly from the moving fulcrum 21*c* that is formed in the shape of an elongated triangle, and has a movable section 21*d* adjacent to the front end section 21*a* for engaging a driving section 5*c* of the black key 5B or a driving section 5*e* of the white key 5W. A cantilever flexible member 21*e* is formed integrally with the first arm 21 along an upper edge of the first arm 21. A first leaf spring 24 is bent and coupled between a leading end of the flexible member 21*e* and a spring retaining section 21*f* that is formed adjacent to a base section of the flexible member 21*e*. The movable section 21*d* engages the driving section 5*c* or 5*e*, and the engagement between the movable section 21*d* and the driving section 5*c* or 5*e* is normally maintained by the spring force of the flexible member 21*e* and the first leaf spring 24.

Figure 5:
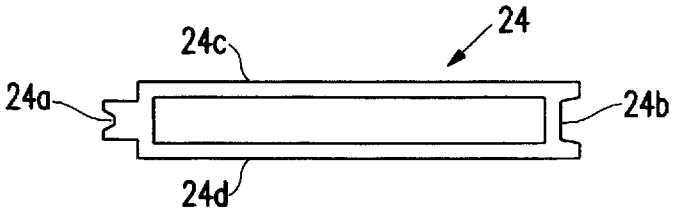
FIG. 5 shows a plan view of a first leaf spring shown in FIGS. 1 and 2.

The first leaf spring 24 is formed in the shape of an elongated frame as shown in a plan view of FIG. 5, and has an engagement section 24*a* at its front end for engaging the leading end of the flexible member 21*e* and an engagement section 24*b* at its rear end for engaging the spring retaining section 21*f*. The first leaf spring 24 has a central aperture that defines two parallel side sections 24*c* and 24*d* to be positioned on both sides of the first arm 21.

The first arm 21 has a rear side section 21*t* that extends rearwardly from the moving fulcrum 21*c* and becomes gradually narrower. The rear side section of the first arm 21 and a front end section of a second arm 22 are mutually, rotatably supported about a shaft 25 that is located relatively close to the moving fulcrum 21*c*. The second arm 22 has front sections 22*s* that sandwich an intermediate portion of the first arm 21 in the thickness direction thereof (see FIGS. 1 and 2).

A second arm retaining section 21*g* is provided slightly rear of and below the shaft 25 of the first arm 21 so that the second arm retaining section 21*g* protrudes diagonally and slightly rearwardly. The second arm retaining section 21*g* has an engagement surface that is provided with a member for preventing excessive deformation of the first arm 21 and the second arm 22 when the action member is still in a detached single unit. In one embodiment, a felt pad is attached by any one of appropriate means, for example glue and the like, to the engagement surface of the section 21*g*. As a result, the felt pad serves to prevent bouncing when assembled.

Further, the first arm 21 and a let-off lever 23 are mutually, rotatably supported with each other about a shaft 28 located relatively close to the rear end section of the first arm 21.

Figure 6:
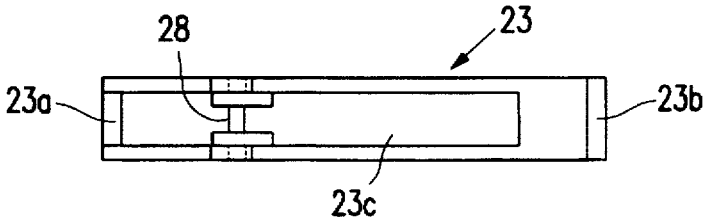
FIG. 6 shows a plan view of a let-off lever shown in FIGS. 1 and 2.

As shown in a plan view of FIG. 6, the let-off lever 23 has a generally triangular shape, a second arm abutting section 23*a* at one end thereof, and a stopper abutting section 23*b* on the other end. The let-off lever 23 has an aperture 23*c* formed in its thickness direction in the central area. The rear section of the first arm 21 is passed through the central aperture 23*c* of the let-off lever 23. The first arm 21 and the let-off lever 23 together function as a whipping function member.

The first arm 21 has a plurality of relatively thick ribs 21*i* formed along a peripheral edge portion 21*h* and along the longitudinal direction spaced from one another. A flat section 21*j* between the ribs 21*i* is relatively thin. This structure provides the first arm 21 with sufficient strength to resist bending when it is molded. Also, this structure allows the first arm 21 to be light in weight, and substantially shifts the center of gravity toward the rear end of the entire mass body assembly 20.

The second arm 22 has a generally U-shaped top open groove about the center. A buffer member 29, made of, for example, a relatively soft and flexible resin, is glued to the surface of the groove. The buffer member 29 defines a first abutting surface 22*c* that abuts against the second arm abutting section 23*a* of the let-off lever 23 at the beginning of the key depression stroke, and a second abutting surface 22*d* that abuts against an external surface of the second arm abutting section 23*a* at the end of the key depression stroke shown in FIG. 2. This structure provides a back check mechanism. The back check mechanism is mainly achieved by abutment between the second arm abutting section 23*a* of the let-off lever 23 and the second abutting surface 22*d* of the second arm 22.

The weight member 22*a* of the second arm 22 has an exposed portion that is generally in the shape of a crank. The exposed portion extends rearwardly through an aperture 1*g* defined in a rear end vertical section of the first frame 1. A cap 30 with an integrally formed flexible cantilever member 30*a* is formed by a resin or the like and outserted on an end of the exposed portion. In an alternative embodiment, the cap 30 and the flexible cantilever member 30*a* may be formed integrally by a spring steel. The weight member 22*a* has a pad 31, for example a felt pad, glued to an upper edge thereof at a location corresponding to a free end of the flexible cantilever member 30*a*. The pad 31 protects the flexible cantilever member 30*a* during key depression.

A lower limit stopper 32 is disposed on a top surface of the shelf board 3. The lower limit stopper 32 is made of felt, rubber or the like and abuts against a lower surface of the weight member 22*a* of the second arm 22 upon key depression shown in FIG. 1.

On the other hand, an upper limit stopper 33, made of felt, rubber or the like, is glued to an interior lower surface of the support member side fulcrum section 4 formed on the first frame 1. As shown in FIG. 2, the stopper abutting section 23*b* and the free end of the flexible cantilever member 30*a* abut against the upper limit stopper 33 at the end of the key depression stroke.

The second arm 22 has a spring retainer section 22*e* formed at the front upper end of the second arm 22. The let-off lever 23 has spring retainer sections 23*d* formed above and below the shaft 28 of the let-off lever 23, and a second leaf spring 34 is bent and coupled between the spring retainer section 22*e* and the spring retainer sections 23*d*.

Figure 7:
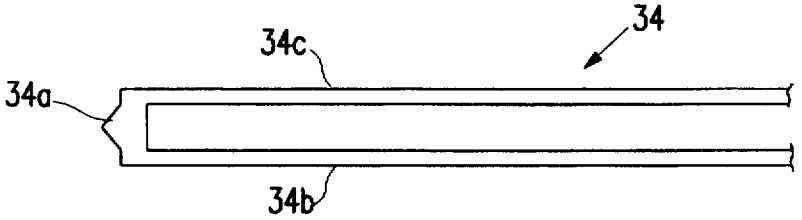
FIG. 7 shows a plan view of a second leaf spring shown in FIGS. 1 and 2.

As shown in FIG. 7, the second leaf spring 34 has a coupling section 34*a* at a front end that engages the spring retainer section 22*e* of the second arm 22, and two spring members 34*b* and 34*c* extending from the coupling section 34*a*. A rear end of the spring member 34*b* engages the lower spring retainer section 23*d* below the shaft 28 on one side (the side which is shown in FIGS. 1 and 2) of the let-off lever 23, a rear end of the spring member 34*c* engages the upper spring retainer section 23*d* above the shaft 28 on the other side (the side which is hidden in FIGS. 1 and 2) of the let-off lever 23.

The second leaf spring 34 provides a differential rotational torque generated by the two spring members 34*b* and 34*c*, and gives a spring force to turn the let-off lever 23 counterclockwise about the shaft 28.

The center of gravity of the entire mass body assembly 20 is located close to the center of gravity of the weight member 22*a* of the second arm 22, and substantially apart from the moving fulcrum section 21 in the opposite side of the movable section 21*d*. As a result, even when the entire mass body assembly 20 is light in weight, a large inertia moment is generated upon key depression, and thus generates effects similar to those of the hammers of an acoustic piano.

Also, the driving sections 5*c* and 5*e* of the white key 5W and the black key 5B, respectively, can be provided about the same position from the moving fulcrums of the respective keys, which is adjacent to the leading end (the free end) of the white key 5W. As a result, the distance from the respective fulcrums to the driving sections 21*d* is substantially large, and a stroke error that is generated at a contact point between the driving section and the movable section is not amplified at a position (at the operating section) where the performer's finger touches the key 5. Accordingly, the stroke accuracy of the mass body assembly 20 (that defines an action member driven by the key 5), with respect to the corresponding driving section (e.g. the movable section 21*d*) is improved.

In accordance with this embodiment, each of the action members includes a mass body, and therefore the stroke accuracy of the keys and the action members is improved and the key touch feeling accuracy is also improved. Further, the action members for the white keys 5W and the black keys 5B are formed in substantially the same shape.

Furthermore, as shown by a phantom line in FIG. 1, key switches 13' may be disposed on the second frame 2 at positions opposing the driving sections 5*c* and 5*e* , and the key switches 13' may be activated through the first arm 21 upon key depression. As a result, the key switch is turned on during the key depression stroke at a specified position more accurately. In other words, the accuracy of tone generation position is improved.

Positions of the moving fulcrum 21*c* and the movable section 21*d* of the first arm 21 for the black keys 5B, shown by a solid line in FIG. 1, are slightly shifted from those of the white keys 5W shown by a phantom lane in FIG. 1. As a result, the distance between the movable section and the moving fulcrum for the black keys is slightly longer than the distance between the movable section and the moving fulcrum for the white keys. As a consequence, the white keys 5W and the black keys 5B provide substantially the same key touch feeling (the counter force).

Although the first arms 21 on the left hand side of a dash-and-dot line A—A shown in FIG. 1 are slightly different in shape between the white keys and the black keys, overall configurations of the mass body assemblies 20 for the white keys and the black keys are generally the same. The first arms 21 on the right-hand side of the dash-and-dot line A—A, the second arms 22 mounted thereon, the let-off levers 23, the caps 20 and the second leaf springs 34 may be made in the same shape and material for both the black keys 5B and the white keys 5W.

Accordingly, the mass body assemblies 20 can be formed from parts that are commonly used by both the white keys 5W and the black keys 5B, and only one set of split metal molds is required for each of the second arm 22 and the let-off lever 23.

The first arms 21 are required to be made by different metal molds for the white keys 5W and the black keys 5B. However, a metal mold may be designed so that the metal mold is split along the dash-and-dot line A—A into a left-hand side mold and a right-hand side mold. The right-hand side mold is commonly used for both the white keys 5W and the black keys 5B. The left-hand side mold is individually prepared for each of the white keys 5W and the black keys 5B and combined with the common metal mold, which is the right-hand side mold. Accordingly, the cost is substantially reduced. The economic effects are significant.

This common mold aspect will be described later in detail with reference to a third embodiment. Effects and benefits of the mass body assembly 20 upon key depression will also be described later in detail.

Figure 8:
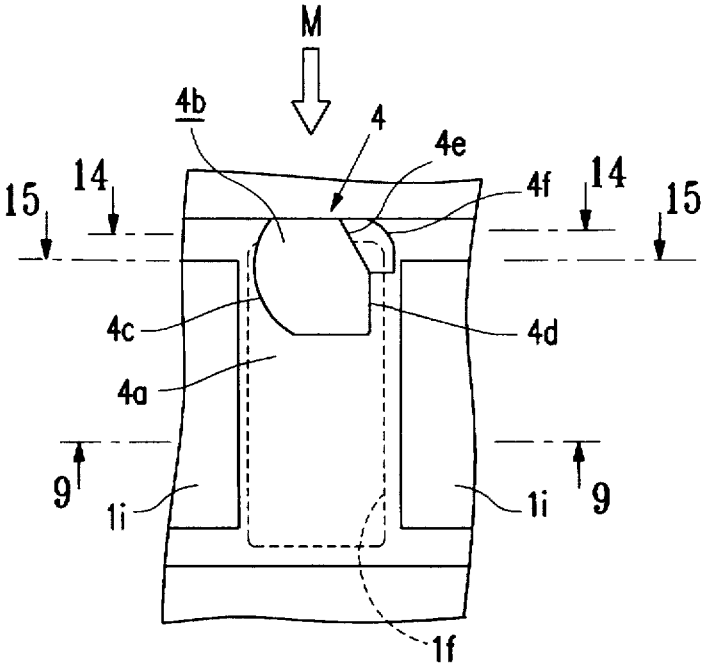
FIG. 8 shows an expanded plan view of the area circled by a dash-and-dot line adjacent to a support member side fulcrum section shown in FIG. 3.
Figure 9:
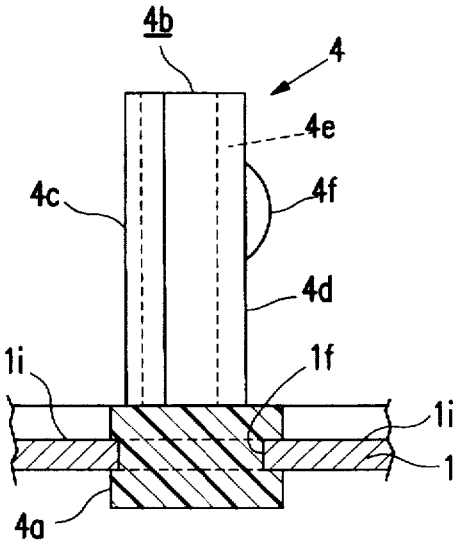
FIG. 9 shows a cross-sectional view taken along the line X—X shown in FIG. 8.
Figure 10:
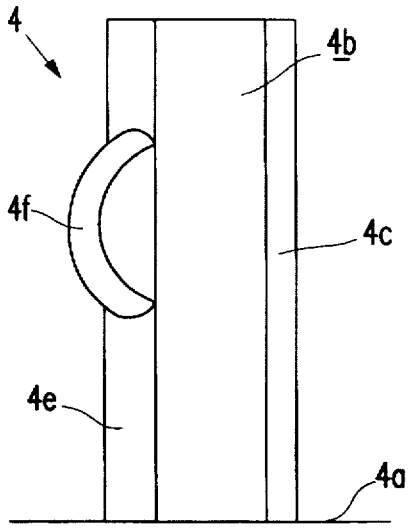
FIG. 10 shows a rear view of the support member side fulcrum section viewed in a direction of an arrow M shown in FIG. 8.
Figure 11:
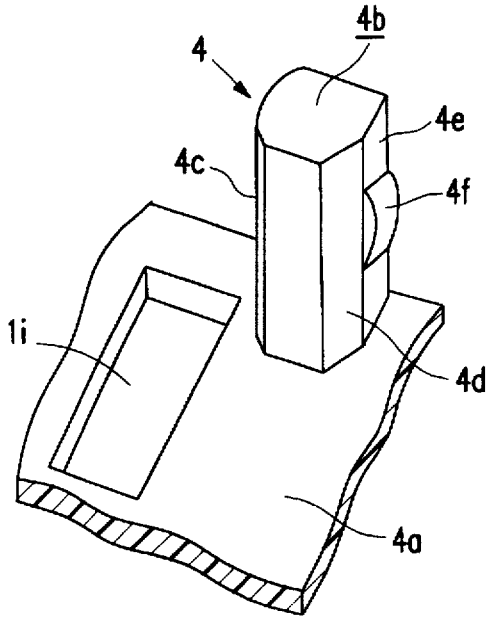
FIG. 11 shows a perspective view of the support member side fulcrum section viewed diagonally from a front side shown in FIG. 8.

FIG. 8 shows an enlarged plan view of an area encircled by a dash-and-dot line L shown in FIG. 3 adjacent to the support member side fulcrum section 4. FIG. 9 shows a cross-sectional view taken along the line X—X shown FIG. 8, and FIG. 10 shows a rear view as viewed in a direction of an arrow M shown in FIG. 8. Also, FIG. 11 is a perspective view of the support member side fulcrum section 4.

The first frame 1 defines an aperture 1*f*. A substrate section 4*a* of the support member side fulcrum section is formed by outserting a resin around the aperture 1*f*. A protruding section 4*b*, that is outserted on the cut-and-bent piece 1*a* shown in FIGS. 1 and 2, is formed integrally with the substrate section 4*a* for each of the keys 5. FIG. 8 shows an exposed surface 1*i* of the first frame 1 on both sides of the substrate section 4*a*.

A cylindrical surface 4*c* having an axis along a vertical direction is formed on one side surface of the protruding section 4*b*. The other side surface defines a flat surface 4*d* in a forward section of the protruding section 4*b* along the key length direction of the key 5, and a rearwardly extending diagonal surface 4*e* in the rearward section of the protruding section 4*b* that thins out the rearward section of the protruding section 4*b*. A bulging section (a curved surface section) 4*f* is formed in the diagonal surface 4*e* at a location slightly above the center of the diagonal surface 4*e* in the vertical direction of the protruding section 4*b*. The cylindrical surface 4*c* does not need to have a peripheral surface of a perfect circle, but may have a deformed column surface.

Figure 12:
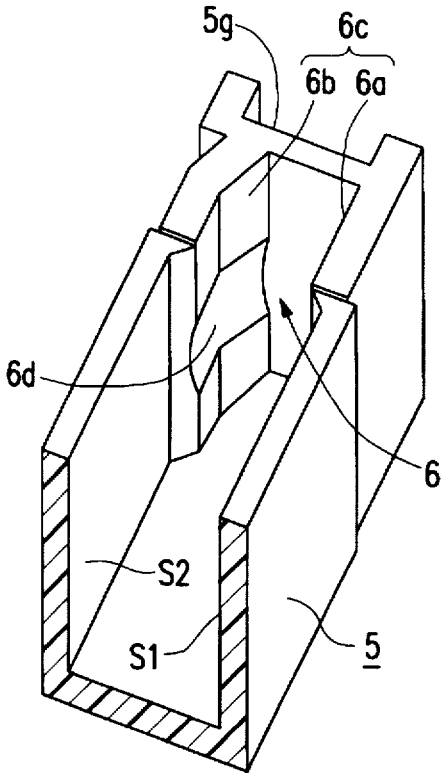
FIG. 12 shows an expanded perspective view of an area adjacent to a major portion of a key side fulcrum section as the key is turned upside down and viewed diagonally from the front side shown in FIG. 8.

On the other hand, FIG. 12 shows a perspective expanded view of a main section of the key side fulcrum 6 as viewed from the front of the key as the key is turned upside down. As shown in FIG. 12, the key 5 (for both the white key and the black key) has two internal surfaces S1 and S2 opposing each other in the key width direction, and a rear end surface 5*g*. Wedge-like wall surfaces 6*a* and 6*b* that narrow toward the rear side of the key are formed in the two internal surfaces near the rear end surface 5*g*. The wedge-like wall surfaces 6*a* and 6*b* define a wedge-like wall surface forming section 6*c* (the wedge surface 6*a* is in parallel with the internal surface S1). The wall surface 6*a* of the wedge-like wall surface forming section 6*c* is flat, and the wall surface 6*b* has a curved concave surface 6*d* about the center of the key in a key height direction that curves in the key height direction and extends in the key length direction to form the key side fulcrum section 6.

Figure 13:
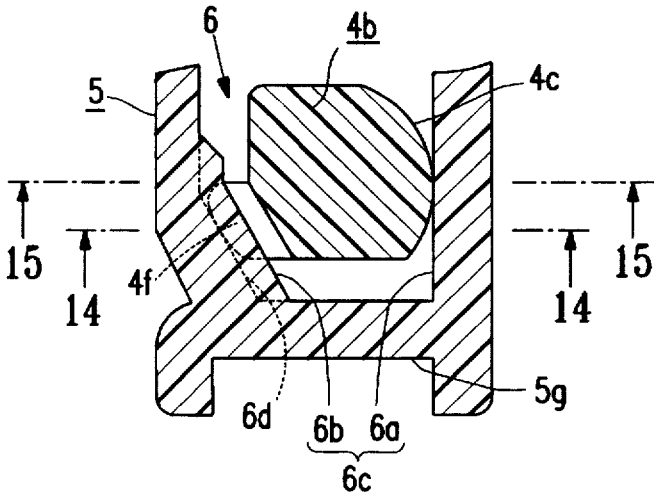
FIG. 13 shows a cross-sectional view taken along the line C—C shown in FIG. 15 in a state in which the key shown in FIG. 12 is supported by a protrusion member shown in FIG. 11.
Figure 14:
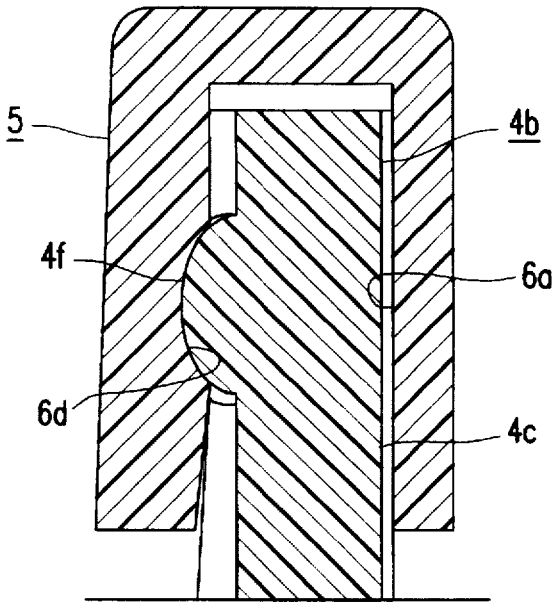
FIG. 14 shows a cross-sectional view taken along the line a—a shown in FIGS. 8 and 13.
Figure 15:
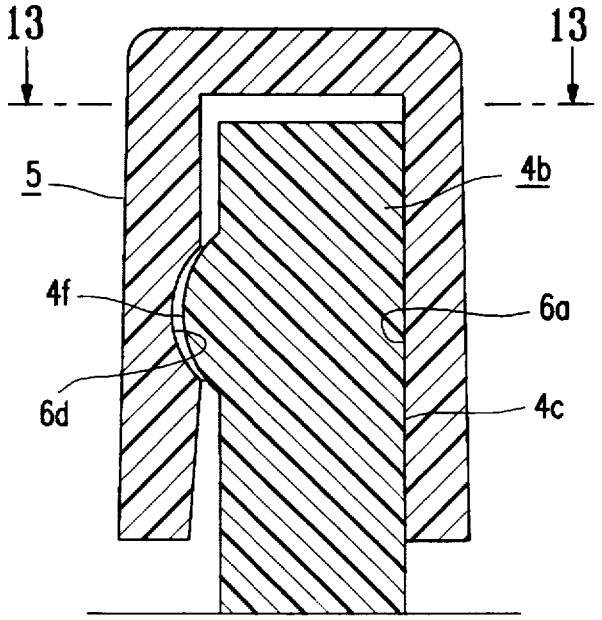
FIG. 15 shows a cross-sectional view taken along the line B—B shown in FIGS. 8 and 13.
Figure 16A:
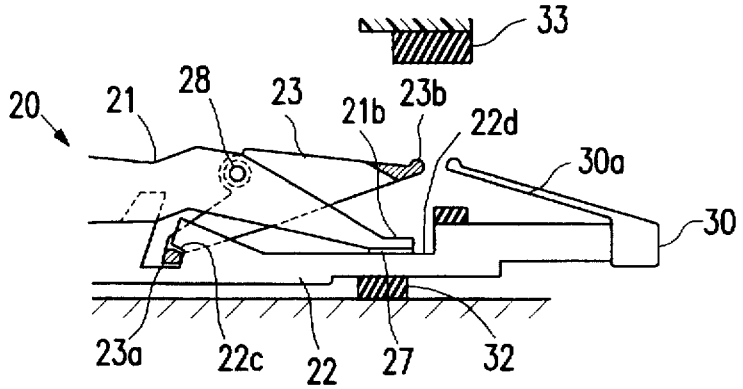
FIGS. 16(*a*)–16(*e*) show side views of a mass body assembly 20 and a whipping function section in accordance with the first embodiment representing movements from a state in which a key is not depressed to a state in which the key is fully depressed by its maximum stroke.
Figure 16B:
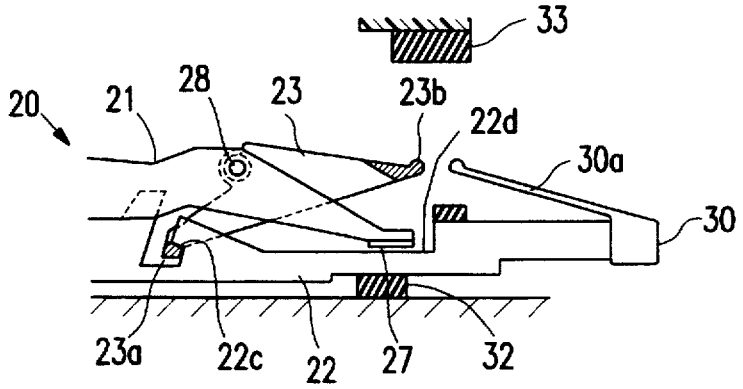
Figure 16C:
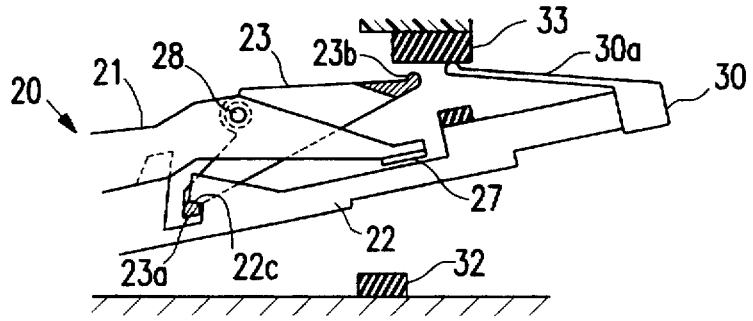
Figure 16D:
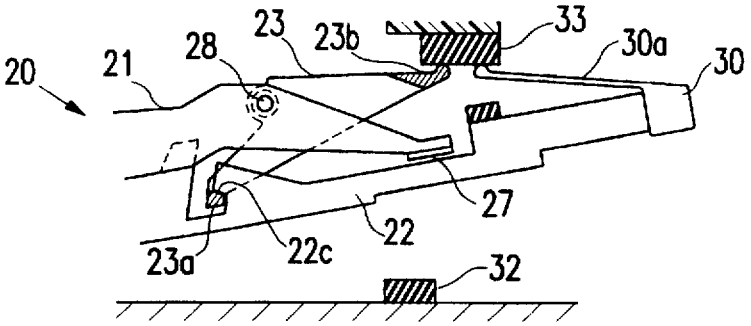
Figure 16E:
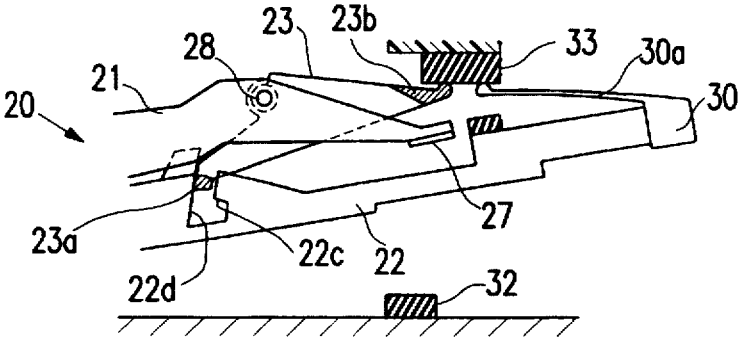

FIG. 13 shows a cross-sectional view taken along the line C—C shown in FIG. 15 where the key 5 is supported by the protruding section 4*b* shown in FIG. 11. FIG. 14 shows a cross-sectional view taken along the lines A—A shown in FIGS. 8 and 13, and FIG. 15 shows a cross-sectional view taken along the lines B—B shown in FIGS. 8 and 13.

The protruding section 4*b* of the support member side fulcrum section 4 is inserted between the wedge-like wall surfaces 6*a* and 6*b* of the key side fulcrum section 6 to provide a key supporting structure to mount each of the keys 5 to the first frame 1. The leaf spring 7 is coupled between each of the keys 5 and each of the support member side fulcrum sections 4 as shown in FIG. 1. As a result, the wedge-like wall surfaces 6*a* and 6*b* are pressed against the column surface 4*c* and the bulging section 4*f* of the protruding section 4*b*.

As shown in FIGS. 14 and 15, the flat wall surface 6*a* of the key side fulcrum section 6 and the column surface 4*c* in the protruding section 4*b* generally come in linear contact with each other along the key height direction in their insertion direction. The concave curved surface 6*d* formed in the other wedge-like wall surface 6*b* and the spherical bulging section 4*f* of the protruding section 4*b* come in point contact or near point contact (small-area contact) with each other.

According to FIG. 14, the bulging section 4*f* comes in linear contact with the curved surface for a very short distance. The concave curved surface 6*d* has a radius of curvature slightly larger than that of the bulging section 4*f* to provide a point contact therebetween. Alternatively, the concave curved surface 6*d* and the bulging section 4*f* may have substantially the same radius of curvature to provide a very short linear contact or a small area contact. Also, when the concave curved surface 6*d* has a central valley line that curves and extends in parallel with a horizontal surface, the above-mentioned very short linear contact may have a small area contact. To provide a long-lasting stable fulcrum structure to a keyboard apparatus which only restricts the rolling movement of keys, the small area contact is preferably provided. It should be noted that the relationship between the concave and convex surfaces of the wedge-like wall surface 6*b* and the protruding section 4*d* may be inverted with respect to one another.

As a result, the key 5 is movable about a fulcrum formed at a contact between the concave curved surface 6*d* of the key side fulcrum section 6 and the spherical bulging section 4*f* of the protruding section 4*b* in a vertical direction (the key depression direction) and in a right-to-left direction (the key width direction). Further, because the flat wall surface 6*a* of the key side fulcrum section 6 and the column surface 4*c* of the protruding section 4*b* are in linear contact with each other in the key height direction, the rolling movement about an axis extending along the key length direction of the key 5 is prevented. Moreover, the curved surface engagement between the concave curved surface 6*d* of the key side fulcrum section 6 and the spherical bulging section 4*f* of the protruding section 4 maintains the fulcrum of the key at a specified position.

Accordingly, this structure absorbs dimensional errors that may occur in disposing the key side fulcrum section 6 and the protruding section 4 in the key arrangement direction, and dimensional errors in those sections formed by warps formed during molding. Therefore, even when the key 5 is relatively long, these errors are absorbed and the keys 5 are driven smoothly for the entire key stroke. Also, since the rolling movement of the key is prevented or reduced, the key 5 may not require a guide member for guiding the key in the vertical direction at the key side, when guided by a mass body assembly 20 or the like.

In accordance with this embodiment, the guide 15 is designed to come in point contact with the internal surfaces of the key only to restrict the position of the key in the key arrangement direction, as described with reference to FIG. 4. As a result, an area that generates friction is reduced, the movement of the key 5 becomes smooth and noise generation even with presence of the above-mentioned dimensional errors is substantially eliminated or reduced.

Further, the key side fulcrum section 6 has the wedge-like wall surfaces 6*a* and 6*b* that are normally pressed against the protruding section 4*b* of the supporting member side fulcrum section 4 by the spring force of the leaf spring 7. As a result, rattles and noises due to the rattles between the key side fulcrum section 6 and the supporting member side fulcrum section 4 are substantially eliminated or reduced, and thus centers of the key side fulcrum section 6 and the supporting member side fulcrum section 4 are self-aligned.

Because each of the keys 5 in the keyboard is movable in the right-to-left direction, the key may be moved in the right-to-left direction during a performance. As a result, modulation effects, such as vibrato, tremolo, pan, reverberation and the like are generated. In this case, each of the key guides may be provided with a lateral movement sensor, such as for example a pressure sensitive sensor including a pressure sensitive film and a pressure sensitive rubber, at positions where the key guide comes in contact with the internal surface walls of the key.

Also, according to this fulcrum structure, the key is movable in two directions perpendicular to each other. In this respect, each of the keys may be turned 90 degrees (the shape of each of the key should be modified so that an operation section of the key is provided at a top surface of the key), and each of the protruding sections at the support member side fulcrum section may be bent in an L-shape and may be horizontally inserted in the key side fulcrum section of each of the keys. In this case, the wedge-like wall surfaces of the key side fulcrum section are formed in the internal wall surfaces of each of the keys 5 that oppose each other in the key height direction.

Next, the effects and benefits of the mass body assembly 20, as an action member described with reference to FIGS. 1 and 2, will be described.

FIGS. 16(*a*)–(*e*) show the step-by-step movements of the mass body assembly 20, mainly the whipping function section of the first embodiment, from a non-key depression state to a maximum-key depression stroke state. In these figures, the let-off lever 23 is shown in a vertical cross-section.

In the state shown in FIG. 16(*a*), the mass body assembly 20 returns to a home position shown in FIG. 1 as the second arm 22 lowers due to its own weight, the second arm 22 abuts against the lower limit stopper 32, and the weight member 22*a* of the second arm 22 abuts against the pad 27 provided at the rear end 21*b* of the first arm 21. The let-off lever 23 is turned counterclockwise by the spring force of the second leaf spring 34. The second arm abutting section 23*a* of the let-off lever 23 is placed under the first abutting surface 22*c* of the second arm 22. However the second arm abutting section 23*a* and the first abutting surface 22*c* of the second arm 22 are not in contact with each other and slightly separated from each other.

When the key 5 is depressed, the movable section 21*d* at the front end section of the first arm 21 is pushed down by the driving section 5*c* or 5*e* (as shown in FIG. 1), and the first arm 21 starts rotating about a fulcrum defined by a contact between the moving fulcrum section 21*c* and the support member 16, in a counterclockwise direction (as shown in FIG. 1).

When the key depression operation involves a predetermined speed (greater than a force causing a pianissimo sound), at a beginning stage of the operation as shown in FIG. 16(*b*), the second arm 22 stays in its place, the first arm 21 together with the let-off lever 23 turn slightly counterclockwise, and the second arm abutting section 23*a* of the let-off lever 23 abuts against the first abutting surface 22*c* of the second arm 22. When the key 5 is depressed with a weak key pressure, less than a force causing a pianissimo sound, the second arm 22 separates from the lower limit stopper 32 with the separation being kept between the second arm abutting section 23*a* and the first abutting surface 22*c* of the second arm 22.

When the key depression force is larger than a force causing a pianissimo sound, the entire mass body assembly 20, including the first arm 21 and the second arm 22 that are coupled by the let-off lever 23, turns counterclockwise as shown in FIG. 16(*c*), and the leading end of the flexible cantilever member 30*a* abuts against the upper limit stopper 33.

Thereafter, the counterclockwise rotation continues with the flexible cantilever member 30*a* being slightly bent, and the stopper abutting section 23*b* of the let-off lever 23 abuts against the upper limit stopper 33 as shown in FIG. 16(*d*).

As the mass body assembly 20 further rotates counterclockwise, the let-off lever 23 turns clockwise about the shaft 28. As a result, as shown in FIG. 16(*e*), the second arm abutting section 23*a* separates from the first abutting surface 22*c* of the second arm 22 and releases the second arm 22.

When the key depression force is less than a force causing a pianissimo sound, while the state in FIG. 16(*a*) is maintained, the states in FIGS. 16(*b*) and 16(*c*) will follow while the second arm abutting section 23*a* of the let-off lever 23 and the first abutting surface 22*c* of the second arm 22 are separated from each other.

After the flexible cantilever member 30*a* abuts against the upper limit stopper 33, the upper limit stopper 33 pushes down the second arm 22, and the second arm abutting section 23*a* of the let-off lever 23 contacts the first abutting surface 22*c* of the second arm 22 described above. Thereafter, movements of the first arm 21, the second arm 22 and the let-off lever 23 are the same as those that take place when the key depression force is strong (greater than a force causing a pianissimo sound).

Thereafter, the second arm 22 rotates counterclockwise in a delicate imbalance between a clockwise returning force caused by the weight of the weight member 22*a* and the spring force of the flexible cantilever member 30*a* and a counterclockwise moment of inertia. Shortly thereafter, the second arm abutting section 23*a* of the let-off lever 23 abuts against the second abutting surface 22*d* of the second arm 22. The connection of the second arm abutting section 23*a* of the let-off lever 23 with the second abutting surface 22*d* of the second arm 22 starts a back checking function to hold the second arm 22. Furthermore, the second leaf spring 34 applies a counterclockwise rotational force to the second arm 22. As a result, the second arm 22 does not abruptly turn clockwise. It is noted that the weaker the key depression force, the smaller the counterclockwise moment of inertia of the second arm 22.

Even when the second arm 22 turns clockwise more than required with respect to the first arm 21, the second arm 22 stops when the second arm 22 abuts against the second arm retaining member 21*g* shown in FIGS. 1 and 2.

Furthermore, the second abutting surface 22*d* of the second arm 22 is formed from the buffer member 29, and the second arm retaining member 21*g* of the first arm 21 has the pad 26 attached to a retaining surface. As a consequence, the second arm 22 does not vibrate due to an impact caused by the contact between the buffer member 29 of the second arm 22 and the pad 26 of the first arm 21.

As the second arm 22 is released by the let-off lever 23 after depression of a key, the static and dynamic let-off feeling similar to that obtained by an acoustic grand piano is generated. Definitions of functions of action mechanisms of a piano are described below to describe the static and dynamic let-off feeling.

Let-off function: When a key is depressed, the key depression force is transmitted through a coupling section to a hammer. The let-off function releases the coupling section connecting the key and the hammer after the hammer strikes a string and allows the hammer to rebound and return to a home position.

Back checking function: The back checking function is a function to hold the hammer that is let off.

Repetition function: The repetition function allows the hammer to return to a state so that the hammer is ready for a succeeding key depression, after the back checking function is released as the key is released.

In a conventional acoustic piano, a whipping assembly of the piano performs the above-mentioned let-off function and the repetition function, and the key performs the back checking function. In contrast, in accordance with this embodiment, the mass body assembly 20 performs all of the functions described above.

Static let-off feeling: When the key is depressed very slowly to an extent that almost no sound is generated, a frictional force generated by a jack and the hammer gradually increases. When the coupling section between the key and the hammer is released, the frictional force decreases, and a released, advancing feeling, namely, a static let-off feeling, is generated.

Dynamic let-off feeling: When the key is depressed with a key depression force stronger than a force causing a pianissimo sound (pp), and when the coupling between the key and the hammer is released just before the key depression is completed, the moment of inertia decreases while the key is still being depressed, and a liberated feeling (a released, advancing feeling), namely a dynamic let-off feeling, is generated. In other words, the dynamic let-off feeling is a feeling generated as a counter force acting against the finger decreases by the decrease of the moment of inertia during key depression.

A keyboard apparatus in an acoustic grand piano has the following functional characteristics:

① Static key touch feeling does not change very much according to different key depression strokes.

② The released, advancing feeling (the static let-off feeling) is generated when the key touch is weak.

③ Dynamic key touch feeling (a weighted feeling) is present, and a weight released feeling (the dynamic let-off feeling) is generated when the key is strongly depressed.

④ Key touch feeling is the same for both white and black keys.

The first embodiment of the present invention described above provides a key touch feeling that is very similar to the key touch feeling of a keyboard apparatus of an acoustic grand piano having the characteristics described above.

An acoustic grand piano has a generally pleasing key touch feeling. Let us describe how and what elements of the acoustic grand piano provide the pleasing key touch feeling, and how and what elements are considered in embodiments of the present invention to provide a key touch feeling similar to the key touch feeling of an acoustic grand piano.

Figure 17:
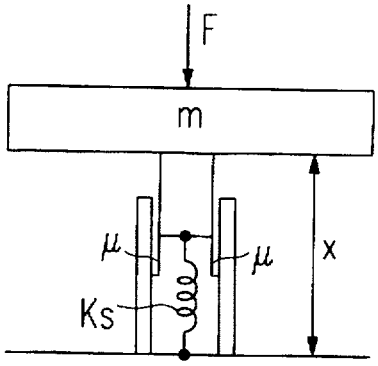
FIG. 17 schematically shows a dynamic system including a mass.

In a system shown in FIG. 17, when an object having a mass m is depressed by a force F, a counter force is generated. The relationship between the force F and the counter force is defined by the following formula based on Newton's second law of motion.

$$F = \underbrace{m(d^2x/dt^2)}_{<1>} + \underbrace{\mu N}_{<2>} + \underbrace{ks \cdot x}_{<3>} \qquad \text{[Formula 1]}$$

where, m is a mass of the object (It may be considered as a mass of a key and an entire action member in the case of a keyboard apparatus.), x is a distance in which the object moves (a key stroke), ks is a spring modulus, μ is a friction coefficient, N is a counter force, and ($d^2x/dt^2$) is an acceleration.

A formula F=mα (where F is a force, m is a mass and α is an acceleration of the mass), which is widely known, is modified into the above Formula 1 due to a complex structure of the system.

The weight of a key and an action member corresponds to a factor <1> in Formula 1 in the case of an acoustic grand piano, and nominally corresponds to the factor <1> in the case of a conventional electronic keyboard apparatus. However, each of the action mechanisms thereof are different from each other, and thus characteristics of m and α change during key depression.

An acoustic grand piano has a repetition spring that provides a spring force, and an electronic keyboard musical instrument has a key return spring. The spring force is defined by a factor <3> in Formula 1. An acoustic grand piano also has many frictional elements, including a friction structure defined by a repetition lever and a hammer (a roller skin). The frictional force is defined by a factor <2> in Formula 1. However, conventional electronic keyboard musical instruments do not have the frictional elements that influence a key touch feeling.

If a keyboard of an acoustic grand piano is combined with an electronic sound source circuit, a supreme electronic keyboard musical instrument is achieved. However, this cannot be practically realized based on the conventional keyboard apparatus because it would be very expensive. The present invention provides a pseudo-combination of a keyboard of an acoustic grand piano and an electronic sound source circuit without substantially increasing the cost of the instrument.

In general, when a moving object (that is moving or that is stopping) applies a force to an environment (the force on the right-hand side of Formula 1), a counter force acts on the object (the force on the left hand side of Formula 1). The force and the counter force have a relation such as defined by Formula 1 described above. In accordance with this embodiment, the factors <1> and <2> in Formula 1 are well balanced, and thus the static let-off feeling and the dynamic let-off feeling (see FIG. 18) are properly provided.

In an acoustic grand piano, a great frictional force is not generated at the beginning of the depression of a key, and an acceleration generated during a former half of a key depression stroke, that is defined by the factor <1> in Formula 1, is gravitational acceleration. In this respect, a force, in which a key operation section acts on a finger pressing the key operation section, is set at about 50~60g. Both μ and N in Formula 1 are substantially zero, therefore, the factor <2> is substantially zero. Since no spring force is generated, the factor <3> is also zero. Therefore, the key moves under a counter force F=mα=50~60 g.

In a later half of the key depression stroke, a regulating button pushes a jack against a repetition spring, and a force represented by the factor <3> is generated. Thereafter, a hammer comes in contact with the jack (when the jack and a roller of the hammer come in contact with each other). From this point, a frictional force increases and the force factor <2> is generated. When this friction is released, the static let-off feeling is generated.

In the above-described embodiment, in the former half of the key depression stroke, the key moves under the influence of a force of F=mα. In the later half of the key depression stroke, which starts when the flexible cantilever member 30*a* abuts against the upper limit stopper 33 (from the state shown in FIG. 16(*c*)), the key moves under the influence of a force of $F=m\alpha+(ks+ksh)\cdot x$, and a frictional force increases. Here, ksh is a spring modulus of the flexible cantilever member 30*a*.

Then, the let-off lever 23 abuts against the upper limit stopper 33. When the key depression force is smaller than a force causing a pianissimo sound, the mass body assembly 20, particularly the second arm 22, does not have a counterclockwise moment of inertia. Accordingly, the second arm abutting section 23*a* starts sliding with respect to the first abutting surface 22*c* of the second arm 22. At this moment, a frictional force is generated. Therefore, the key 5 moves under the influence of a force of $F=m\alpha+\mu N+kso\cdot x$, where $kso=ks+ksh$. When the engagement between the let-off lever 23 and the second arm 22 is released, the force factor <2> in Formula 1 becomes substantially zero, and the released, advancing feeling (the static let-off feeling) is generated.

In an acoustic grand piano, a key depression force is actively coupled to the hammer when the key touch is greater than a force causing pianissimo sound. In general, it is known that inertia is generated when an object starts moving and when the object stops moving. The inertia is represented by a moment of inertia I by a formula, $I=mr^2$, where r is for example a distance between the rotation fulcrum s and a key depression position. Therefore, the moment of inertia represents a system that rotates.

When an external moment is Ne, and an angular velocity is ($\omega$, the external moment Ne is defined by $Ne=I(d\omega/dt)$, where ($d\omega/dt$) is an angular acceleration. The moment of inertia I, the angular acceleration ($d\omega/dt$) and the external moment correspond, in principle, to the mass m, the acceleration $\alpha$, and the force F in the above Formula 1, respectively.

In the case of an acoustic grand piano, all of the force factors on the right-hand side of Formula 1 work in an initial stage of a key depression stroke. However, the factor <1> is particularly larger that other factors. Namely, through generating an inertia that is required to start moving the hammer, a finger receives a large counter force defined by the factor <1> of Formula 1.

Immediately before the completion of the key depression stroke, the engagement between the key and the hammer is released. Namely, the hammer approaches a corresponding string without a force transmitted from the key, and thus the moment of inertia of the hammer decreases. As a result, the dynamic released, advancing feeling is generated. Through these movements, forces relating to all of the factors in Formula 1 take place. In particular, in a later half of the key depression stroke after the initial key depression stage, a player feels a key touch feeling at her finger as though all the force factors relating to the hammer have disappeared.

In the above-described embodiment, all of the factors on the right side of Formula 1 work during the initial stage of a key depression stroke. However, there is a play (a space) about an engaging area between the let-off lever 23 (corresponding to a jack) and the second arm 22 as described with reference to FIG. 16(*a*), and thus the play achieves the following objects.

The play at the engaging area (ranging from 0.3 mm~1.0 mm) allows a smooth coupling between the let-off lever 23 and the second arm 22 when the key 5 returns (when a tone can be regenerated).

When a key touch force is greater than a force causing a pianissimo sound, an inertia is generated. Therefore, the mass body assembly 20 successively moves from the state shown in FIG. 16(*a*) to the states shown in FIGS. 16(*b*), 16(*c*), 16(*d*) and 16(*e*). Accordingly, the second arm 22 does not move due to inertia during the key depression initial stage because of the presence of the play. After the state shown in FIG. 16(*b*), the second arm 22 starts moving toward the upper limit stopper 33. At this stage, all of the factors in Formula 1 manifest themselves with factor <1> being significantly larger than the other factors.

When a key touch is relatively weak, the corresponding acceleration is small. However, the force factor <1> does not substantially change the states shown in FIGS. 16(*b*) through 16(*d*). From a moment when the flexible cantilever member 30*a* abuts against the upper limit stopper 33 as shown in FIG. 16(*c*), the factor $kso\cdot x$ increases in the same manner as the static let-off feeling is generated. In the state shown in FIG. 16(*d*), the factor $\mu N$ (mainly, the counter force N) increases and the friction surfaces between the second arm abutting section 23*a* and the first abutting surface 22*c* slide with respect to each other. When a coupling between the let-off lever 23 and the second arm 22 is released, the factor $kso\cdot x$ and the rotational moment decrease, and the assembly reaches the state shown in FIG. 16(*e*).

When a key touch is strong, the corresponding moment of inertia decreases. This is because the second arm 22, that takes up a major portion of the mass m which is an essential element of the moment of inertia, is released from the key 5, and the second arm 22 has an unrestricted movement. Namely, a subtraction of m1−m2 takes place (where m1 is the entire mass of a key 5 and the action member, and m2 is a mass of the second arm 22), and the entire mass effectively becomes smaller. As a result, the moment of inertia decreases.

Figure 18:
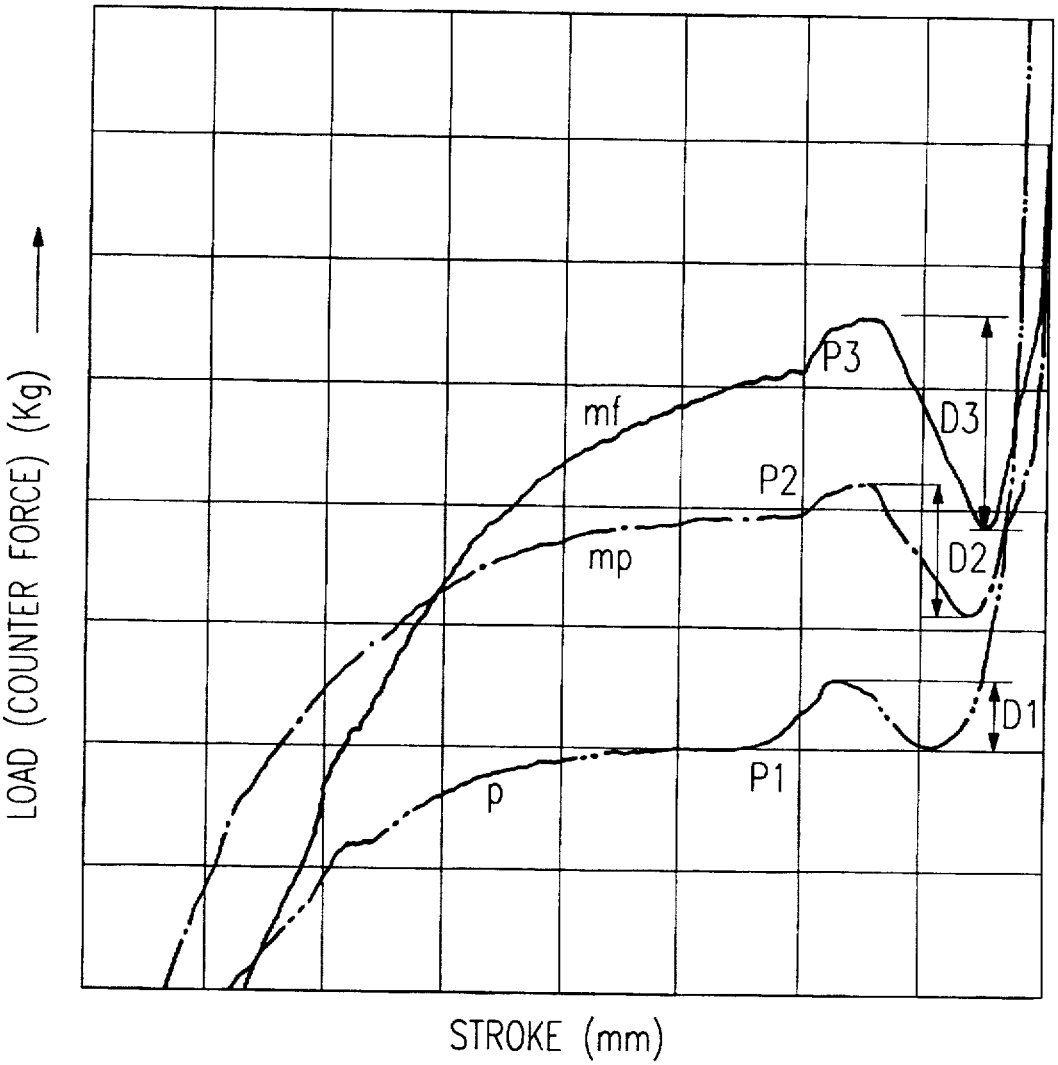
FIG. 18 shows relationships between key strokes and applied loads in the keyboard apparatus according to the first embodiment based on actual measurements.

FIG. 18 shows diagrams of measured relationships between key strokes (in mm) and loads (counter forces in Kg) in a keyboard apparatus according to an embodiment of the present invention. A solid line represents a relationship when a key depression force equals a force causing a mezzo forte sound (mf), a dash-and-dot line represents a relationship when the key depression force equals a force causing a mezzo piano sound (mp), and a diagram in a dash-and-two-dot line represents a relationship when the key depression force equals a force causing a piano sound (m). In each of the cases, a key is depressed with a finger being in contact with the key. Each of points P1, P2 and P3 represents a point at which the let-off lever 23 abuts against the upper limit stopper 33.

In these diagrams, each dip amount (D1, D2 and D3) from each of the respective maximum values is representative of the magnitude of the dynamic let-off feeling. Therefore, it is appreciated from the relationships that the greater the key depression force, the greater the magnitude of the dynamic let-off feeling. In FIG. 18, the dip amount D3 is greater than the dip amount D2, and the dip amount D2 is greater than the dip amount D1 (D1<D2<D3). In accordance with the formula $F=m\alpha$, the greater the key depression force, the greater the acceleration $\alpha$, and thus the greater the product of $m\alpha$. As a consequence, the greater the amount of effective decrease in the mass, which takes place when the mass (e.g. the second arm 22) is released from the entire mass of the key 5 and the action member, the greater the amount of decrease in the factor ma (e.g., D1, D2 and D3 in FIG. 18).

Characteristics shown in FIG. 18 are very similar to the characteristics of an acoustic grand piano, and therefore a dynamic let-off feeling similar to that of an acoustic piano is achieved. As a result, the first embodiment of the present invention provides a keyboard apparatus that achieves substantially the same high quality key touch feeling as that of an acoustic grand piano at a relatively low cost.

In particular, in accordance with the first embodiment, the second arm 22, that is a main mass body, and the whipping function members (the first arm 21 and the let-off lever 23) are assembled to define an action member, namely, the mass body assembly 20, and the main mass body is released at a specified position during a key depression stroke.

This embodiment is preferably applicable to a keyboard apparatus of an electronic piano. However, this embodiment is also applicable to other keyboard apparatuses, and to training apparatuses for training on the piano and the electronic piano.

Figure 19:
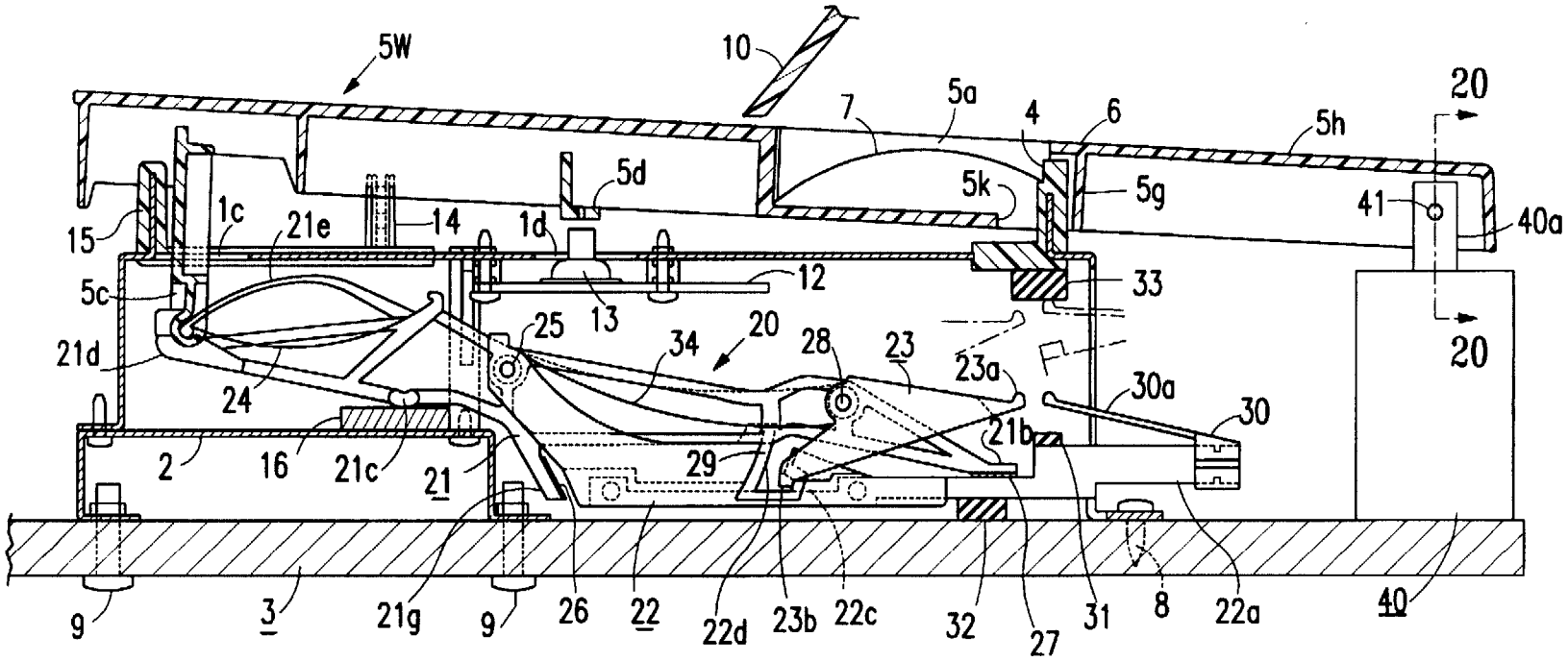
FIG. 19 shows a cross-sectional view of a white key taken along the key length direction in a state wherein the key is not depressed in accordance with a second embodiment.
Figure 20:
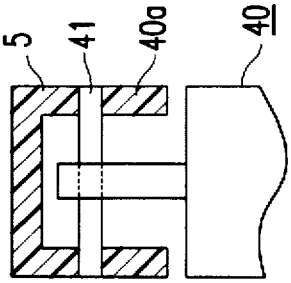
FIG. 20 shows a cross-sectional view taken along the line D—D shown in FIG. 19.

A second embodiment of the present invention will now be described with reference to FIGS. 19 and 20. In accordance with the second embodiment, a keyboard apparatus is driven by an electromagnetic actuator for performing automatic performances. FIG. 19 shows a cross-sectional view of a white key 5W along the key length direction in a state wherein the key 5 is not depressed, and which is similar to the state of the first embodiment shown in FIG. 1. Most of the mechanical structures and functions of the second embodiment are common to those of the first embodiment. Accordingly, the common sections are referred to with the same reference numerals as the corresponding sections of the first embodiment, and their descriptions are omitted.

The second embodiment is different from the first embodiment in the following aspects. Each of white keys 5W and black keys 5B (not shown see FIG. 1), that form a keyboard, are provided with a rearwardly extending section **5*h* extending from a rear end face 5*g*. Furthermore, an electromagnetic actuator 40 having an actuator section 40*a* is mounted on a shelf board 3 for each of the keys 5, and both walls of the rearwardly extending section 5*h* are pivotally connected to the actuator sections 40 by a pin 41 adjacent to a rear end of the rearwardly extending section 5*h*. FIG. 20 shows a cross-sectional view of the pivotally connected portion as shown along a line D—D of FIG. 19**.

In accordance with this embodiment, each of the keys 5 is a see-saw type key. Therefore, when the rearwardly extending section **5*h* is pushed up by the actuator section 40*a* of the electromagnetic actuator 40 during an automatic performance, the key rotates about a key side fulcrum 6** in a similar manner as the key rotates when the front end side of the key is depressed by a performer.

The electromagnetic actuator 40 is activated and controlled by a control circuit and a driving circuit (not shown) based on performance data that is already stored or is supplied from an external device. The electromagnetic actuator 40 pushes out the actuator section **40*a* when current is circulated. When current is not circulated, the actuator section 40*a* is unrestricted. The actuator section 40*a*** is light in weight, and does not substantially influence the key touch feeling described above when a performer plays the keyboard.

According to the first embodiment (FIG. 1, etc.) and the second embodiment (FIG. 19), the keys can be made shorter or longer without substantially changing their structures because of the novel fulcrum structures. In other words, even if the key structure is changed, most parts of the required metal molds can be commonly used for the different key structures.

Figure 21:
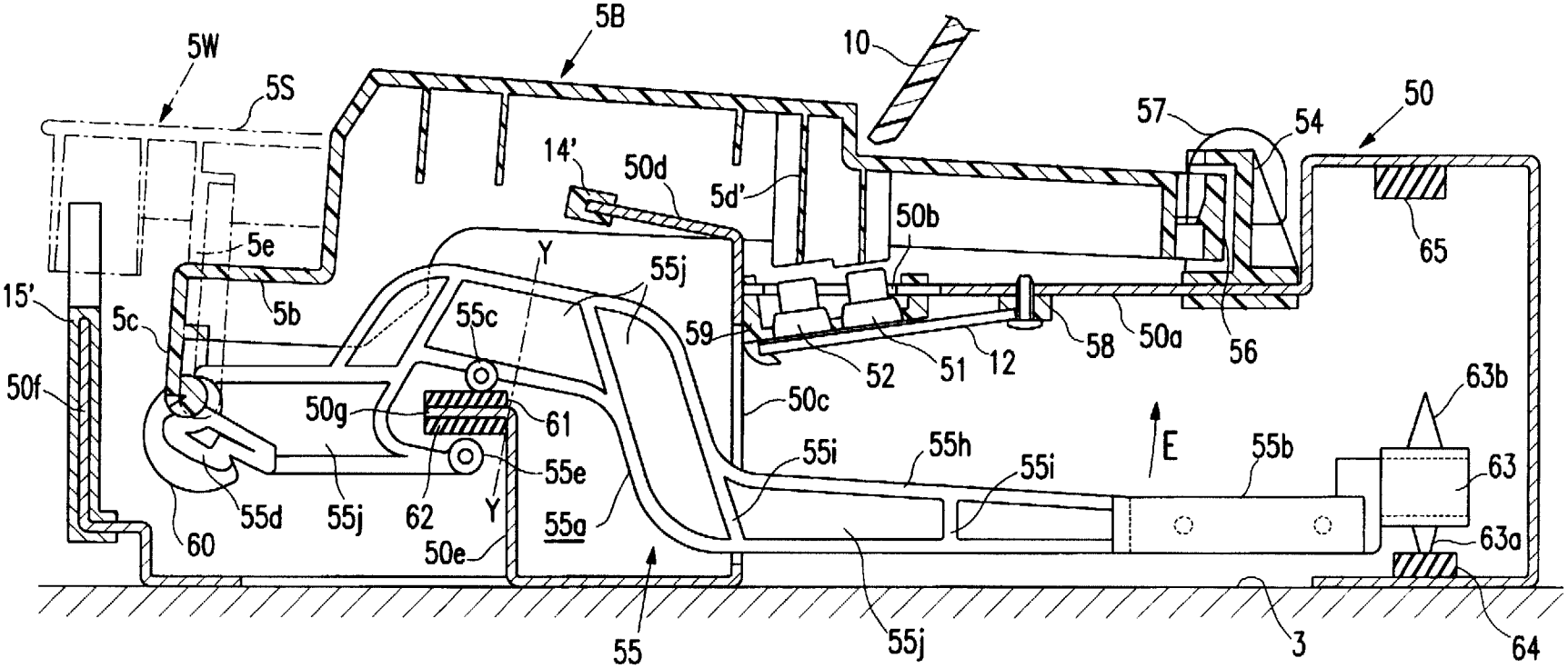
FIG. 21 shows a cross-sectional view of a black key taken along the key length direction in a state in which the key is not depressed in accordance with a third embodiment of the present invention.

A third embodiment of the present invention is described below with reference to FIG. 21. In the third embodiment, the action system of the first embodiment is simplified. FIG. 21 shows a cross-sectional view of a black key 5B taken along the key length direction in a state wherein the black key 5B is not depressed, and which is similar to the state of the first embodiment shown in FIG. 1. Sections in FIG. 21 that are generally common to those shown in FIG. 1, are referred to with the same reference numerals, and the description of these sections is omitted.

A keyboard frame 50 functions as a support member. The keyboard frame 50 is formed from a metal, such as an iron plate, by a metal plate processing or the like, and fixed by screws (not shown) to a shelf board 3 of the body of a musical instrument.

A support member side fulcrum 54 is provided for each of the keys 5 (white keys 5W and black keys 5B are generally referred to as the keys 5) on an upper horizontal surface **50*a* of the keyboard frame 50 adjacent to a rear end section. The support member side fulcrum 54 is formed with a resin by an outsert method. A key side fulcrum section 56, provided adjacent to a rear end section of each of the keys 5, is inserted in the support member side fulcrum 54. A fulcrum pressure spring 57 is coupled between the fulcrum section 56 and the support member side fulcrum 54 so that the key side fulcrum section 56 is normally pressed against the support member side fulcrum section 54**.

Accordingly, each of the keys 5 is supported in a manner that allows movement in a vertical direction (a key depression direction) and in a right-to-left direction (a key width direction) with respect to the keyboard frame 50, but restricts a rolling movement about an axis along the key length direction.

The support side fulcrum section 54 and the key side fulcrum section 56 may have a convex-concave relationship that is inverted with respect to the convex-concave relationship of the support member side fulcrum section 4 and the key side fulcrum 6 of the first embodiment, the detailed description of which is omitted.

The keyboard frame 50 has an upper horizontal surface **50*a* which defines a key switch aperture 50*b* adjacent to a front end section. A switch substrate 12 is mounted below the key switch aperture 50*b* by substrate retaining members 58 and 59 so that the switch substrate 12** is tilted with its front end being lower.

Two key switches 51 and 52, each having a cup-like flexible member, are disposed along the key length direction on an upper surface of the switch substrate 12 for each of the keys. Each of the keys has a two-make key switch actuator **5*d'* that successively presses the key switch 51 and key switch 52** to turn on in this order upon depression of the key.

By use of the key switches 51 and 52, a key depression is detected, as well as a key depression strength or a key depression speed, based on a time difference between the two timings at which the two key switches 51 and 52 are successively turned on. Thus the key switches 51 and 52 define a two-make touch response switch.

Further, a cut-and-bent section **50*d* is cut along the aperture 50*b* of the keyboard frame 50 and bent upwardly toward the front side of the key 5 so that the cut-and-bend and-bent section 50*d* is tilted with a front end being higher. A black key guide 14' is formed with a resin by an outsert method at the front end of the cut-and-bent section 50*d*. The black key guide 14 is inserted between two opposing internal walls of the black key. The black key guide 14 comes in point contact with the opposing walls to restrict the position of the black key 5B in the key arrangement direction. The keyboard frame 50 also has a lower horizontal wall and a vertically extending member 50*f* extending from a front end of the lower horizontal wall. A white key guide 15' is formed on the vertically extending member 50*f* with a resin by an outsert method, and inserted between opposing walls of each of the white keys 5W in a manner that the white key guide 15' comes in point contact with the opposing walls to restrict the position of the white key 5W** in the key arrangement direction.

In accordance with the third embodiment, a mass body arm 55 is provided for each of the keys 5 as an action member. The mass body arm 55 is formed from an arm main body 55*a* that curves in the vertical direction and extends along the key length direction, and a weight member 55*b* that is fixed to a rear end of the arm main body 55*a* and extends rearwardly therefrom.

The arm main body 55*a* is made of a resin or the like, and has a thick peripheral edge section 55*h* along a periphery of the arm main body 55*a* and thick reinforcing rib sections 55*i* spaced from each other in the key length direction. Flat sections 55*j* surrounded by the thick sections 55*i* are relatively thin. As a result, the arm main body 55*a* has sufficient strength to resist deformations at the time of molding, and is light in weight. Also it is designed so that the center of gravity of the arm main arm 55*a* is closer to the rear end of the arm main body 55*a* as much as possible.

The arm main body 55*a* has a frontal upwardly curved section and a cylindrical moving fulcrum 55*c* at a lower edge of the frontal upwardly curved section. The cylindrical moving fulcrum 55*c* is mounted on a support pad 61 attached to a support section 50*g* that is bent in an inverted L shape in a cut-and-bent section 50*e* which is cut in the keyboard frame 50. An auxiliary fulcrum 55*e* having a circular peripheral surface opposes and is spaced a distance from the moving fulcrum 55*c*. The auxiliary fulcrum 55*e* is positioned adjacent to an auxiliary pad 62 attached to a lower surface of the support member 50*g*. The support pad 61 and the auxiliary pad 62 are made of, for example, cloth, felt or the like.

The arm main body 55*a* has a movable section 55*d* formed at the front end of the arm main body 55*a*. The movable section 55*d* is coupled to an extension section 5*b* of the black key 5B that is similar to the first embodiment or an actuator section 5*c* or 5*e* that is provided adjacent to the free end section of the white key 5W. A pressure spring 60 is coupled between the driving section 5*c* or 5*e* and the movable section 55*d* to normally bring the driving section 5*c* or 5*e* and the movable section 55*d* together.

A weight member 55*b* is made of a heavy metal material, such as iron, and is attached to the end section of the arm main body 55*a* by an appropriate method, such as a snap-in coupling, screws, glue or the like. An end section of the weight member 55*b* is bent upwardly in the shape of a crank and has a cap 63 fixed thereto. The cap 63 has a cone-shaped flexible downward protrusion 63*a*, made of for example rubber, on a lower surface thereof, and a cone-shaped flexible upward protrusion 63*b*, made of for example rubber, on a top surface thereof.

A lower limit stopper 64 is mounted on a top surface of a lower wall of the keyboard frame 50 and an upper limit stopper 65 is mounted on a lower surface of a top wall of the keyboard frame 50 in places opposing the flexible protrusions 63*a* and 63*b* , respectively. The lower limit stopper 64 and the upper limit stopper 65 are made of felt or rubber, and abut against the flexible protrusions 63*a* and 63*b* to prevent or minimize the mass body arm 55 from bouncing when the mass body arm 55 is moved, and to restrict the range of movement of the mass body arm 55.

In accordance with this embodiment, a free end section of the black key 5B extends under operation sections 5S of two adjacent white keys 5W toward the free ends of the white keys 5W. A driving section 5*c* is formed at the free end of the extended section of the black key 5B. As a result, in a similar manner as the first embodiment (FIG. 1, and the like), the stroke accuracy of a movable section (the mass body arm 55, or the key switches 51 and 52) is improved with respect to the driving section.

When the operation section of the black key 5B or the white key 5W is depressed, the driving section 5*c* or 5*e* pushes down the movable section 55*d* of the mass body arm 55, and the mass body arm 55 that is a movable section rotates about the moving fulcrum 55*c* in a direction of an arrow E, as shown in FIG. 21. As a result, the weight member 55*b* goes up, and the center of gravity of the mass body arm 55 shifts. The amount of shift of the center of gravity with respect to a specified key depression stroke is determined by a ratio of a distance between the moving fulcrum and a contact point between the driving section and the movable section to a distance between the moving fulcrum and the center of gravity. The mass body arm 55 functions in a similar manner as a hammer in an acoustic grand piano, and the moment of inertia of the mass body arm 55 gives a key touch feeling to a finger of the player in proportion to a key depression strength.

When the flexible protrusion 63*b* abuts against the upper limit stopper 65, the impact is absorbed and thus the movement of the mass body arm 55 is stopped while bouncing is substantially prevented or reduced. When the key is released, the mass body arm 55 turns by its own weight in a direction opposite to the arrow E, and the key 5 also moves upwardly and returns in association with the movement of the mass body arm 55. Therefore, this keyboard apparatus does not have springs for returning the keys to their undepressed position.

According to the third embodiment, the stroke accuracy and the touch feeling accuracy of the action member are improved and the cost is reduced in a similar manner as achieved by the first embodiment described above, as compared with conventional keyboard apparatuses (for example, one shown in Japanese Utility Model Patent HEI 5-954). These features are further described with reference to FIG. 23.

Figure 23:
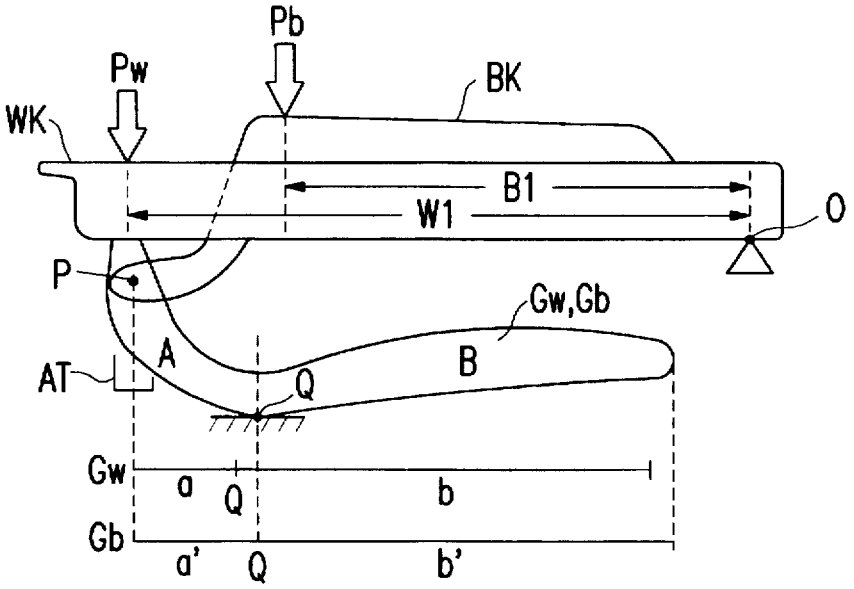
FIG. 23 schematically shows a side view of a system including a black key, a white key, and common action members for the white and black keys.
Figure 24:
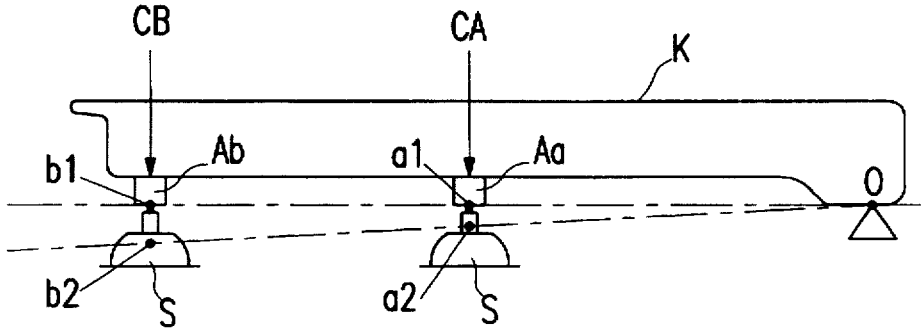
FIG. 24 schematically shows a side view of a key and key switchs using cup-shaped flexible members.

Marks, BK, WK, Gb and Gw in FIG. 23 correspond to the black key 5B, the white key 5W, the mass body arm 55 for the black key and the mass body arm 55 for the white key shown in FIG. 21, respectively. A fulcrum O, a moving fulcrum Q and a position P shown in FIG. 23 correspond to the moving fulcrum defined between the support member side fulcrum section 54 and the key side fulcrum section 56, the moving fulcrum defined at a contact between the moving fulcrum section 55*c* of the mass body arm 55 and the support pad 61, and a driving position at which the key driving section 5*c* or 5*e* drives the mass body arm 55 (or at which the key driving section 5*c* or 5*e* engages the movable section 55*d*), respectively.

First, the stroke accuracy is considered. Let us assume that the fulcrum O of the white key WK or the black key BK is separated a distance L from the driving position P of the action member Gw or Gb (the same applies when an actuator AT disposed below the driving position P actuates the key switch), and the distances L for the white key and the black key are the same. Let us also assume that a white key depression position Pw is separated a distance W1 from the fulcrum O, and a black key depression position Pb is separated a distance B1 from the fulcrum O. The stroke accuracy for the white key is $L/W1 \simeq 1$ (because $W1 \simeq L$). On the other hand, the stroke accuracy for the black key is $L/B1 \simeq 1.2$. It is noted that the greater the value, the higher the accuracy. A typical conventional keyboard apparatus generally has a relation $L<B1<W1$, its stroke accuracy is thus less than "1". In particular, the stroke accuracy for the white key is low.

These values are presented only as an example. However, in accordance with this embodiment, the driving position of the action member for either of the white key and the black key is located adjacent to the white key operation section. As a result, an error in the driving section is not multiplied at the operation position (the abovementioned accuracy is equal to or more than 1), and an error in the driving section for the black key is reduced. Accordingly, the overall stroke accuracy is improved.

Key touch feeling (a counter force received by the finger) for the white key WK and the black key BK may be made equal if a relationship W1/B1=a'/a is established, where each of a and a' represents a horizontal distance between the point P and the point Q for each of the action member Gw for the white key and the action member Gb for the black key, respectively. When the length of a rear section (B) of each of the action member Gw and Gb extending rearwardly from the respective moving fulcrum Q is b and b', respectively, a relationship b/a>>1 (b/a=3~4) is established. Therefore, when a relationship b'=b is established, namely the section B is commonly made for the white key and the black key, and a smaller section a is slightly modified for the white key and the black key, substantially the same key touch feeling is realized for both the white key and the black key.

For example, to simplify the description, let us assume that a=50 mm, b=200 mm, and a'/a=1.2. Thus, a'=1.2 a=60 mm if b=b'.

When b≠b' and b is slightly longer than b', a difference between a and a' is much smaller. For example, when b~b' equals to 4~5 mm, a'/a is about 1.15, and thus a'=57.5. Therefore, section A of the action member for the black key is only 7.5 mm longer.

As a result, the action members for the white key and the black key, namely the mass body arms 55 for the white key and the black key shown in FIG. 21 are disposed substantially at the same position. As a consequence, the stoppers and the support member side fulcrum sections corresponding to the respective action members can be commonly used for all of the keys 5W and 5B.

In the embodiment shown in FIG. 21, longer sections of the mass body arms 55 on the right side of a dash-and-dot line Y—Y are commonly formed for the white key 5W and the black key 5B, and a shorter section on the left side for the white key 5W is slightly shorter than that for the black key 5B.

In this case, the support sections **50*g*, the support pads 61 and the auxiliary pads 62 provided above and below the support sections 50*g*, the lower limit stoppers 64 and the upper limit stoppers 65 are commonly used for all of the keys 5, and arranged along the key arrangement direction. The support section 50*g*, the support pad 61, the auxiliary pad 62, the lower limit stopper 64 and the upper limit stopper 65** for each of the keys are arranged in a narrow strip.

In principle, a two-split type metal mold is sufficient to form a resin part, such as this type of mass body arm 55, even if the mold has a structure to avoid under-cut. However, in practice, a split type metal mold, that can be split into 4 to 8 blocks, is used because it is easy to work with and a failure in the molded part can be corrected by simply replacing the particular block that caused the failure.

To form the arm main body **55*a* of the mass body arm 55** in this embodiment, only the sections on the left side of the dash-and-dot line Y—Y are required to be changed for the white key and the black key. Most of the parts of the split type metal mold can be commonly used for the white keys and the black keys.

For example, a split metal mold for molding the common section on the right side of the arm main body **55*a* and a split metal mold for molding the section on the left side for the white keys 5W are combined to form a required quantity of the arm main bodies 55*a* for the white keys 5W. Then the left side metal mold is replaced with a split metal mold for molding the section on the left side for the black keys 5B to form a required quantity of the arm main bodies 55*a* for the black keys 5B**. Consequently, the number of required metal molds is substantially reduced, and thus the cost is also substantially reduced.

Figure 22:
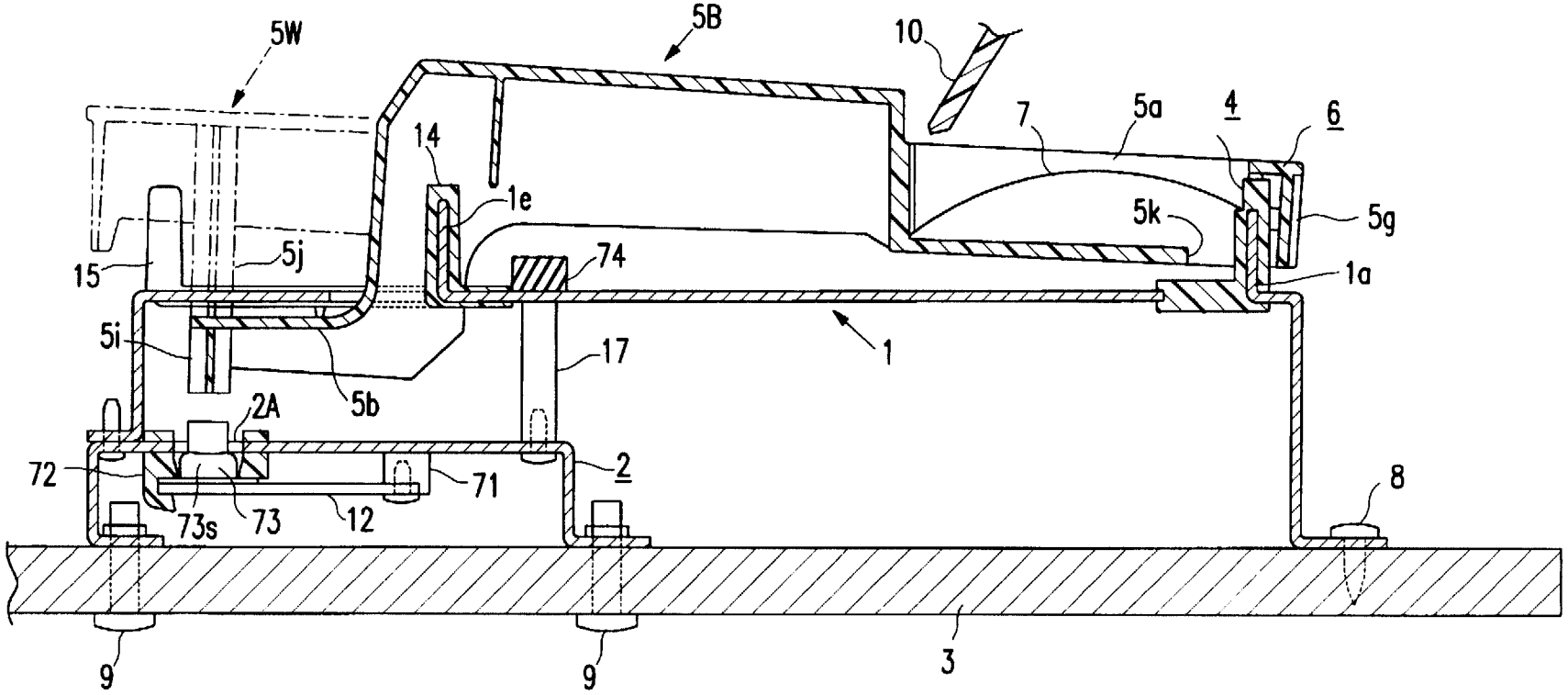
FIG. 22 shows a cross-sectional view of a black key taken along the key length direction in a state in which the key is not depressed in accordance with a fourth embodiment.

A fourth embodiment of the present invention will be described with reference to FIG. 22. FIG. 22 shows a cross-sectional view of a black key 5B taken along the key length direction, in a state where the black key 5B is not depressed, and which is similar to the state of the first embodiment shown in FIG. 1. Sections in FIG. 21, that are generally common to those shown in FIG. 1, are referred to with the same reference numerals, and the description of these sections is omitted.

The fourth embodiment does not have an action member. A second frame 2 defines an aperture 2a for a key switch 73 at a front section of the second frame 2, and a switch substrate 12 is retained below the aperture **2*a* by substrate retaining members 71 and 72. The key switch 73 has a cup-like flexible member 73*s*, and is disposed on a top surface of the switch substrate 12 at a place corresponding to each of the keys 5, in a manner such that the cup-like flexible member 73*s* protrudes through the aperture 2*a***.

A black key 5B has an extension section **5*b* that extends under operation sections of two adjacent white keys 5W toward the free ends of the white keys 5W. A leading end (free end) of the extension section 5*b* has a key switch driving actuator 5*i* that extends downwardly and opposes the cup-like flexible member 73*s* of each of the key switches 73. A key switch driving actuator 5*j*, that extends downwardly and opposes the cup-like flexible member 73*s* of each of the key switches 73, is also provided adjacent to the free end of the white key 5W. Stoppers 74 are made from for example felt and disposed adjacent to a rear side of black key guides 14 on a first frame 1. The stoppers 74 are commonly used for the white keys 5W and the black keys 5B** and arranged in the key arrangement direction.

In accordance with this embodiment, the key switch driving actuators **5*j* and 5*i* are positioned at locations substantially far from moving fulcrums of the white keys 5W and black keys 5B (adjacent to the operation sections of the white keys 5W). As a result, an error in a switching position where the key switch 73 is turned ON with respect to a specified key depression stroke is not amplified, and therefore the stroke accuracy in generation of a tone is improved. Moreover, substantially the same accuracy is provided by either of the white key 5W and the black key 5B, and the key switches 73 can be arranged generally at the same location in the key length direction and along the key arrangement direction. As a result, the switch substrate 12** has a simple structure and thus can be readily assembled.

Alternatively, a two-make touch response switch similar to the one used in the third embodiment shown in FIG. 21 can be provided as a key switch.

Each of the embodiments described above includes key switches that are used in keyboard apparatuses, such as electronic pianos and electronic organs in which an electronic sound source circuit generates sounds based on an ON signal from each of the key switches. The present invention is not limited to these types of keyboard apparatuses.

For example, the present invention is also applicable to other keyboard apparatus musical instruments in which a sound generating member, including for example strings and vibration plates, is vibrated directly by a key operation or through an action mechanism. Alternatively, the present invention is applicable to keyboard apparatuses in which blowing sounds are generated by opening and closing valves, keyboard electronic musical instruments in which generated sounds are electrically amplified. Furthermore, the present invention is also applicable to training keyboard apparatuses such as for example acoustic pianos having action mechanisms and electronic pianos.

As described above, keyboard apparatuses in accordance with embodiments of the present invention have an improved stroke accuracy of the driving section with respect to movable sections such as action members and key switches that are driven by depression of the white keys or the black keys. When a key switch is driven, the accuracy in the switching position at which a tone is generated with respect to a specified key depression stroke is improved. When an action member is driven, the stroke accuracy and the key touch feeling accuracy are improved.

Furthermore, action members can be formed in substantially the same shape for both the white keys and the black keys. As a result, the number of parts and the number of split type metal moldings can be reduced, and therefore the cost is lowered.

Moreover, each of the action members is formed from a mass body assembly that is an integration of a mass body and a whipping function member. As a result, the mass body is released during the course of depression of a key, and a high quality key touch feeling (static let-off feeling and dynamic let-off feeling) that is equivalent to the key touch feeling of an acoustic grand piano is obtained from both the white keys and the black keys.

Also, by using a moving fulcrum structure for each of the keys in accordance with the embodiments of the present invention, dimensional errors can be absorbed even when each of the keys is long, and the keys are smoothly driven for the entire key stroke. In this case, a twisting force is not generated between the key and each of the corresponding key guide members, and thus the keys are correctly aligned, and the key operation becomes smoother.

Each of the key guide members comes in contact with opposing internal walls of each of the keys at a point or in a small area that approximates a point. As a result, the friction between the key and the key guide is reduced, a tilt therebetween in the vertical direction is permissible to a small extent, and a much smoother key operation is achieved.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A keyboard apparatus comprising:

a support member;

a keyboard including a plurality of white keys and black keys, each of the white keys and the black keys being mounted on the support member and having a first fulcrum on one end thereof and a free end portion on another end thereof and capable of pivoting about the first fulcrum with respect to the support member, each of the white keys having an operation section closer to the free end portion thereof;

a movable section mounted on the support member and associated with each of the white keys and the black keys;

a white key driving member connected adjacent to the free end portion of each of the white keys, the white key driving member for moving the movable section associated with each of the white keys;

an extended section connected to the free end portion of each of the black keys, the extended section extending under the operation sections of two adjacent white keys to an area adjacent to the free end portions of the two adjacent white keys to thereby form a free end at an end of the extended section; and a black key driving member connected adjacent to the free end of the extended section of each of the black keys, the black key driving member for moving the movable section associated with each of the black keys.

2. A keyboard apparatus as defined in claim 1, wherein the white key driving member and the black key driving member are located about the same distance from the respective first fulcrums of the corresponding white key and the black key.

3. A keyboard apparatus as defined in claim 1, wherein the movable section is a key switch.

4. A keyboard apparatus as defined in claim 1, wherein the movable section is an action member pivotal about a second fulcrum in cooperation with the corresponding key to provide the corresponding key with a moment of inertia of the action member when the corresponding key is depressed.

5. A keyboard apparatus as defined in claim 4, wherein shapes of the action members to be driven by the white keys and the black keys are substantially similar to each other.

6. A keyboard apparatus as defined in claim 1, wherein the first fulcrum of each of the white keys and the black keys allows each of the white keys and the black keys to move in a key depression direction and a key width direction with respect to the support member, and prevents each of the white keys and the black keys from rolling about an axis of each of the the white keys and the black keys extending in a key length direction of each of the white keys and the black keys.

7. A keyboard apparatus as defined in claim 6, further comprising a plurality of key guide members, each being fixed to the support member and associated with each of the white keys and the black keys, wherein each of the plurality of key guide members is inserted into each of the white keys and the black keys to substantially prevent movement of each of the white keys and the black keys in a key arrangement direction in which the white keys are arranged side by side.

8. A keyboard apparatus as defined in claim 7, wherein each of the white keys and the black keys has opposing internal walls, and each of the key guide members comes in contact with the opposing internal walls of each of the white keys and the black keys substantially at a point.

9. A keyboard apparatus as defined in claim 8, wherein each of the key guide members comes in contact with the opposing internal walls of each of the white keys and the black keys in a small area larger than a point.

10. A keyboard apparatus comprising:

a support member;

a keyboard including a plurality of white keys and black keys, each of the white keys and the black keys being mounted on the support member and having a first fulcrum on one end thereof and a free end portion on another end thereof, each of the white keys and the black keys being capable of pivoting about the first fulcrum with respect to the support member;

a driving member formed adjacent to the free end portion of each of the white keys and the black keys; and an action member mounted on the support member and driven by the driving member about a second fulcrum in cooperation with the corresponding key to provide the corresponding key with a moment of inertia of the action member when the corresponding key is depressed, wherein the action members to be driven by the driving members of the white keys and the black keys are generally in the same shape, and each of the action members is formed by a mass body and a whipping function member assembled together.

11. A keyboard apparatus as defined in claim 10, wherein the driving members of the white keys and the black keys are located about the same distance from the respective first fulcrums of the corresponding white keys and the black keys.

12. A keyboard apparatus as defined in claim 10, wherein the first fulcrum of each of the white keys and the black keys allows each of the white keys and the black keys to move in a key depression direction and a key width direction with respect to the support member, and prevents each of the white keys and the black keys from rolling about an axis of each of the the white keys and the black keys extending in a key length direction of each of the white keys and the black keys.

13. A keyboard apparatus as defined in claim 12, further comprising a plurality of key guide members, each being fixed to the support member and associated with each of the white keys and the black keys, wherein each of the plurality of key guide members is inserted into each of the white keys and the black keys to substantially restrict movement of each of the white keys and the black keys in a key arrangement direction in which the white keys are arranged side by side.

14. A keyboard apparatus as defined in claim 13, wherein each of the white keys and the black keys has opposing internal walls, and each of the key guide members comes in contact with the opposing internal walls of each of the white keys and the black keys substantially at a point.

15. A keyboard apparatus as defined in claim 14, wherein each of the key guide members comes in contact with the opposing internal walls of each of the white keys and the black keys in a small area larger than a point.

* * * * *